US008578647B2

(12) United States Patent
Storch et al.

(10) Patent No.: US 8,578,647 B2
(45) **Date of Patent: *Nov. 12, 2013**

(54) LOCKING QUICK RELEASE CLAMP ASSEMBLY

(75) Inventors: Troy Storch, Waukesha, WI (US); John Gross, Mukwonago, WI (US); William Orne, III, New Berlin, WI (US); Eric Stephen Kincel, Tucson, AZ (US)

(73) Assignee: American Defense Manufacturing, LLC, New Berlin, WI (US)

( * ) Notice: Subject to any disclaimer, the term of this patent is extended or adjusted under 35 U.S.C. 154(b) by 288 days.

This patent is subject to a terminal disclaimer.

(21) Appl. No.: 12/892,059

(22) Filed: Sep. 28, 2010

(65) Prior Publication Data

US 2011/0076095 A1 Mar. 31, 2011

Related U.S. Application Data

(63) Continuation-in-part of application No. 12/024,619, filed on Feb. 1, 2008, now Pat. No. 7,823,316.

(60) Provisional application No. 60/844,812, filed on Jan. 12, 2007.

(51) Int. Cl.
*F41G 1/38* (2006.01)

(52) U.S. Cl.
USPC ..... 42/124; 248/187.1

(58) Field of Classification Search
USPC ..... 42/90, 124, 127, 140, 125; 248/187.1, 248/176.3; 396/428, 419
See application file for complete search history.

(56) References Cited

U.S. PATENT DOCUMENTS

| | | | |
|---|---|---|---|
| 2,597,565 | A | 5/1952 | Chandler et al. |
| 2,791,950 | A | 5/1957 | Oppenheimer |
| 2,824,504 | A | 2/1958 | Bethmann |
| 2,840,334 | A | 6/1958 | Cauthen |
| 3,324,558 | A | 6/1967 | Hart |
| 3,356,325 | A | 12/1967 | Schnase |
| 3,677,509 | A | 7/1972 | O'Connor |
| 4,351,224 | A | 9/1982 | Curtis |
| 4,531,321 | A | 7/1985 | Bechtel |

(Continued)

FOREIGN PATENT DOCUMENTS

| | | |
|---|---|---|
| JP | 97395 | 4/2000 |
| WO | WO/93/15371 | 1/1993 |

(Continued)

OTHER PUBLICATIONS

Technical Manual, TM 9-4931-710-14&P, dated Aug. 1986, Department of the Army International Search Report (ISR) and the Written Opinion (PCT/US2009/032837).

*Primary Examiner* — Bret Hayes
*Assistant Examiner* — Reginald Tillman, Jr.
(74) *Attorney, Agent, or Firm* — Boyle Fredrickson, S.C.

(57) ABSTRACT

Systems and methods for securely mounting devices and/or accessories to vehicles and/or other supporting structures. The systems include a shaft having a longitudinal axis. A pair of clamp bodies cooperates with the shaft so that a distance is defined between the clamp bodies. A lever is engaged with the shaft and operable to alter the distance between the clamp bodies. A lock supported by the lever movably engages the shaft and maintains the orientation of the clamp bodies relative to one another by maintaining an orientation of the lever relative to the shaft so that the lever can only be operated when the lock is disengaged from the shaft.

22 Claims, 29 Drawing Sheets

(56) References Cited

U.S. PATENT DOCUMENTS

| | | | |
|---|---|---|---|
| 4,539,769 | A | 9/1985 | Stevens et al. |
| 4,724,692 | A | 2/1988 | Turin et al. |
| 4,742,636 | A | 5/1988 | Swan |
| 4,768,049 | A | 8/1988 | Barrett et al. |
| 4,845,871 | A | 7/1989 | Swan |
| 4,869,378 | A | 9/1989 | Miller |
| 4,911,348 | A | 3/1990 | Rasor et al. |
| 4,929,973 | A | 5/1990 | Nakatani |
| 5,005,813 | A | 4/1991 | Lawrence |
| 5,071,050 | A | 12/1991 | Pudney et al. |
| 5,142,806 | A | 9/1992 | Swan |
| 5,155,915 | A | 10/1992 | Repa |
| 5,177,823 | A | 1/1993 | Riach |
| 5,222,826 | A | 6/1993 | Hanke |
| 5,276,988 | A | 1/1994 | Swan |
| 5,390,419 | A | 2/1995 | Sirkis |
| 5,582,044 | A | 12/1996 | Bolich |
| 5,590,484 | A | 1/1997 | Mooney et al. |
| 5,601,265 | A | 2/1997 | Lopez |
| 5,606,818 | A | 3/1997 | Hardee |
| 5,685,105 | A | 11/1997 | Teetzel |
| 5,737,657 | A | 4/1998 | Paddock et al. |
| 5,852,892 | A | 12/1998 | Bilgeri et al. |
| 5,870,641 | A | 2/1999 | Chrosziel |
| 5,881,486 | A | 3/1999 | Bilgeri et al. |
| 5,941,489 | A | 8/1999 | Fanelli et al. |
| 6,026,580 | A | 2/2000 | LaRue |
| 6,026,582 | A | 2/2000 | Donohue et al. |
| 6,196,504 | B1 | 3/2001 | Lemke |
| 6,289,622 | B1 | 9/2001 | Desch et al. |
| 6,318,015 | B1 | 11/2001 | Baumann et al. |
| 6,378,237 | B1 | 4/2002 | Matthews et al. |
| 6,435,738 | B1 | 8/2002 | Vogt |
| 6,442,883 | B1 | 9/2002 | Waterman |
| 6,622,416 | B2 | 9/2003 | Kim |
| 6,637,144 | B2 | 10/2003 | Nelson et al. |
| 6,648,287 | B2 | 11/2003 | Wooten |
| 6,701,081 | B1 | 3/2004 | Dwyer et al. |
| 6,705,038 | B2 | 3/2004 | Davenport et al. |
| 6,722,076 | B2 | 4/2004 | Nielsen |
| 6,773,172 | B1 | 8/2004 | Johnson et al. |
| 6,779,290 | B1 | 8/2004 | Houtsma |
| 6,785,997 | B2 | 9/2004 | Oz |
| 6,792,711 | B2 | 9/2004 | Battaglia |
| 6,851,214 | B2 | 2/2005 | Oz |
| 6,854,206 | B2 | 2/2005 | Oz |
| 6,922,934 | B1 | 8/2005 | Huan |
| 6,923,412 | B2 | 8/2005 | Wooten et al. |
| 6,931,778 | B1 | 8/2005 | Nelson et al. |
| 6,931,779 | B1 | 8/2005 | Galuppo |
| 7,077,582 | B2 | 7/2006 | Johnson |
| 7,090,174 | B2 | 8/2006 | Korczak et al. |
| 7,096,620 | B2 | 8/2006 | Zeh |
| 7,107,716 | B1 | 9/2006 | Liao |
| 7,185,862 | B1 | 3/2007 | Yang |
| 7,204,052 | B2 | 4/2007 | Swan |
| 7,222,451 | B2 | 5/2007 | Da Keng |
| 7,243,456 | B2 | 7/2007 | Williams |
| 7,260,912 | B2 | 8/2007 | Liu |
| 7,272,904 | B2 | 9/2007 | Larue |
| 7,308,772 | B1 | 12/2007 | Millett |
| 7,370,449 | B1 | 5/2008 | Beckman |
| 7,493,721 | B2 | 2/2009 | Swan |
| 7,562,485 | B2 | 7/2009 | Newhall et al. |
| 2005/0241212 | A1 | 11/2005 | Swan |
| 2006/0117636 | A1 | 6/2006 | Newhall et al. |
| 2006/0123686 | A1 | 6/2006 | LaRue |
| 2006/0207156 | A1 | 9/2006 | LaRue |
| 2006/0242882 | A1 | 11/2006 | Liu |
| 2007/0074443 | A1 | 4/2007 | La France |
| 2007/0163163 | A1 | 7/2007 | Munst |
| 2007/0234623 | A1 | 10/2007 | Carney |
| 2008/0034638 | A1 | 2/2008 | Spuhr |
| 2008/0092421 | A1 | 4/2008 | Beckmann |
| 2008/0092424 | A1 | 4/2008 | Keng |

FOREIGN PATENT DOCUMENTS

| | | |
|---|---|---|
| WO | WO/2005/085744 | 3/2005 |
| WO | WO/2006/050163 | 5/2006 |
| WO | WO/2007/067569 | 6/2007 |

LOCKING QUICK RELEASE CLAMP ASSEMBLY

CROSS-REFERENCE TO RELATED APPLICATIONS

This application is a continuation in part and claims priority to U.S. patent application Ser. No. 12/024,619 filed on Feb. 1, 2008 now U.S. Pat. No. 7,823,316 and which claims the benefit of U.S. Patent Application Ser. Nos. 60/884,812, filed Jan. 12, 2007, and 11/959,020, filed Dec. 18, 2007, the disclosures of each of which are hereby incorporated in their entirety by reference.

BACKGROUND OF THE INVENTION

1. Field of the Invention

The present invention relates in general to the field of firearms. More particularly, the present invention relates to a lockable quick release assembly that is useable in various contexts including gun mounts. Specifically, one embodiment of the present invention relates to a quick release-mounting device for a weapon. Another embodiment of the invention includes a lockable quick release assembly useable to secure one or more sporting accessories in a secure manner and in a manner wherein the accessories can be quickly and conveniently moved between one or more stored position(s) and one or more in-use position(s) without the need for supplemental tools.

2. Discussion of the Related Art

As the field of combat weaponry expands, numerous add-on enhancements have become available for attachment to standard firearms thereby significantly upgrading the capability of the firearm. However, because of the variety of shapes of the upper receivers of different firearms, the add-on enhancements must be modified each time they are sold for a different firearm. Such individualization increases the cost associated with such add-on enhancements.

The Swan/Weaver rail described in U.S. Pat. No. 4,845,871, incorporated herein by reference and hereinafter referred to as the '871 patent, addresses a portion of this problem. The female portion of the rail is a quick detachable interface means for modular enhancements. However, the rail requires a first rail (Weaver rail) to be attached to the firearm, typically to the arced handle on the U.S. Army M16 combat firearm, and different means on other types. The first rail must be designed for each firearm to accommodate the differences between firearm receivers. Since the male portion of the Swan/Weaver rail is easily removed by the firearm operator, they are also easily lost and calibration and weapon sighting are difficult and nonuniform.

As mentioned, the increasing complexity of combat has generated a need for weapons with increased accuracy and which are capable of supporting various accessories. These accessories include flashlights, infrared and night vision scopes, laser spotters, and so forth. Consequently, a wide variety of mounts for rifles and other hand weapons have been developed which permit mounting of accessories or sighting devices on the weapon, often along the barrel.

These modular weapon systems generally include Picatinny rails or other such rails or tracks, often using MIL-STD-1913 for standardization of the mounting systems, and are affixed to the barrel or stock of the weapon for mounting accessories thereon. A variety of designs have been suggested for such modular weapon systems and such rails, as well as differing numbers of rails, which can be coupled at one time to a weapon. At present, it is known to mount up to four rails to a weapon.

Since the rails are generally mounted on the handguard (or handguard replacement) of the weapon, accessories mounted thereon must be zeroed often, since the alignment of the accessory relative to the barrel changes slightly during firing of the weapon or if the weapon receives a shock (i.e., falls).

Recently, floating rails have been suggested such as rails attached to a weapon in such a way as not to contact the barrel. These generally are attached at the rear only, in order to attempt to provide more stability over time. However, these rails, also, suffer from alignment problems due to the shock created by the gases and recoil energy generated during firing. In addition, most of these rails can be mounted only by an armorer, by taking apart the barrel and sight and reassembling the weapon with the floating rails.

The below-referenced U.S. patents and published U.S. applications disclose embodiments that were at least in part satisfactory for the purposes for which they were intended. The disclosures of all of the below-referenced prior United States patents and applications, in their entireties, are hereby expressly incorporated by reference into the present application for purposes including, but not limited to, indicating the background of the present invention and illustrating the state of the art.

U.S. Pat. No. 7,096,620 to Zeh entitled "Device for mounting a telescopic sight on a weapon" is a device for mounting a telescopic sight onto a weapon. The device is equipped with two mounting feet, which are positioned at a distance from one another and provided with mounting elements for engaging in corresponding receiving openings on the weapon. The aim of the invention is to enable the sight to be positioned accurately without the need for a complex adjustment and fitting process. To achieve this, the mounting elements are configured by clamping bolts, which comprise laterally protruding lugs, are contained in the corresponding mounting feet and can be rotated through a release and locking position. The lugs can be inserted into recesses between inward-facing projecting shoulders of the receiving openings in the release position of the clamping bolts and engage with the underside of the projecting shoulders in the locked position of the bolts.

U.S. Pat. No. 6,785,997 to Oz discloses an "Accessory mount for a firearm." The accessory mount, and a method for mounting accessories for a hand held firearm has a barrel and a mounting rail coupled beneath the barrel. The accessory mount includes a frame, defining a substantially flattened bottom surface and a track for mounting along the mounting rail. The frame has a cavity for receiving a light, and a bipod mount coupled adjacent the track and behind the light cavity and arranged to hold a bipod having legs which can be folded substantially adjacent the barrel.

U.S. Pat. No. 6,851,214 to Oz discloses a "Flashlight mount for a firearm." The flashlight mount, and a method for mounting a flashlight, for a rifle having a barrel and a mounting rail coupled to the barrel includes a frame having a bore for receiving a flashlight. The frame defines a substantially flattened bottom surface, and a base for mounting along the mounting rail. The base is distanced from the frame, thereby creating a finger-receiving aperture therebetween.

U.S. Pat. No. 5,590,484, to Mooney et al., discloses a universal mount for a rifle which is formed to support a series of accessory devices simultaneously. The mount comprises an upper rail, a lower rail, a heat shield, and a retaining clip. When in place, this mount enables the rifle to be used as a weapons' platform, simultaneously supporting a plurality of accessory devices that enhance the operational capabilities of the weapon. A major feature of this invention is that the mount is secured to the barrel so that it "follows" the direction of the barrel when the latter undergoes thermal deformation as a result of firing successive rounds of ammunition. This enables the weapon to remain accurate despite the number of rounds fired or the temperature of the barrel.

U.S. Pat. No. 6,318,015 to Baumann, et al., discloses a holding device for a weapon barrel which includes a casing extension on the casing of the weapon, and a longitudinal rail integrally formed on the top of the casing and on the casing extension as a mounting for the telescopic sight.

U.S. Pat. No. 5,881,486 to Bilgeri et al. discloses a hand-held firearm with a light casing. This firearm also includes a casing extension having a mounting for a telescopic sight.

U.S. Pat. No. 5,685,105 to Teetzel discloses an apparatus for attaching an accessory to a firearm. This apparatus includes a chassis containing a flashlight that can be mounted in various positions, depending on the weapon selected. The weapons factory installed hand grips are replaced by modified hand grips that contain the flashlight electronic controls, water proof activation switches, and power source.

Other U.S. patents of interest include U.S. Pat. Nos. 4,845,871, 5,276,988, 5,142,806 to Swan, and 6,026,582 to LaRue.

Some of the above devices suffer from a number of disadvantages. First, conventional mounts are substantially cylindrical in cross-section, such that their bottom surface is curved, so they provide no stability if the weapon is leaned upon a wall, for example. Second, often the mounts are relatively small, so as to permit mounting of several different accessories and reduce weight. However, this structure makes it difficult to comfortably grip the weapon while holding the mount, and often places the user's hand in close proximity to the hot barrel during firing. Third, conventional mounts generally have a selected location along the barrel at which they are affixed. Thus, this location is often not optimal for users of different heights and different arm lengths.

Accordingly, there is a long felt need for an accessory mount for a rifle or other hand-held firearm which provides a strong grip and stability for the weapon, and it would be desirable to have such a mount whose mounting location along the barrel is adjustable according to the length of the arm of the user.

Therefore, what is needed is a rail and quick release mount that is easy to use, durable, flexible, will not damage the rifle or the mounting rail, and does not require special tools to mount.

Aside from firearm mounting conditions discussed above, the activity of firearm use, whether combative or recreational, often includes a number of accessories related to the activity. For instance, during virtually any outdoor excursion, a user commonly secures or stows gear that may be needed for any particular outing in any of a number of vehicles such as over the road vehicles such as recreational vehicles (RV's) and campers, cars, and more commonly pickup trucks. Depending upon the accessibility to the intended destination and the intended activity, in addition to the road vehicles mentioned above, many outdoor enthusiasts, independent of pursuing firearm related activities, also commonly operate motorized and non-motorized vehicles such as all-terrain vehicles (ATV's) including three-wheelers, four wheelers, and amphibious vehicles, watercraft such as personal watercraft (PWC's) canoes and boats, golf carts, motorcycles and bicycles, etc.

Depending on the activity undertaken, many outdoor enthusiasts commonly transport many activity and/or emergency situation accessories or implements throughout their excursions. Commonly, the accessories can be transferred between vehicles, move between stored and in-use positions, as the situation dictates. Some accessories; such as electronic devices like cell phones, global positioning systems (GPS), range finders, fish finders, speakers, lights, cameras, computers, electronic sights, televisions, etc, can be sensitive to impacts or uncontrolled movement whether stowed or in use. Other, generally non-electronic equipment, like accessory containers, bags, utility boxes, gun or fishing pole racks, quiver mounts, vehicle wheels, water bottle or liquid containers, downriggers, etc. are less susceptible to damage from impacts but are often desired to be supported or otherwise attached to the underlying vehicle in a secure manner. Regardless of the specific accessory, it is also often desired to move or remove the accessory from a stored position to an in-use position. Depending on the type of accessory, it may also be desirable to have the accessory securely mounting to an underlying structure or additional tool or accessory when either used or stored.

Accordingly, there is also a need for an accessory mounting system that is convenient to operate, is fully operable without the use of tools, provides a robust and secured mounting arrangement when engaged, and which allows repeatable removal and/or engagement with one or more accessories.

SUMMARY OF THE INVENTION

By way of summary, one aspect of the present invention provides a mounting system for a rifle or carbine, such as an AR-15, M-16, or other firearm, such as a mounted .50 caliber machine gun, preferably having a barrel and a mounting rail coupled to the barrel. The mounting system includes a frame defining a substantially flattened bottom surface, and a base for mounting along the mounting rail, the base being distanced from the frame, creating a finger-receiving aperture therebetween.

One aspect of the present invention generally includes a system for mounting an accessory to a firearm rail. The mounting system includes a mounting device that is selectively attachable to the rail of a firearm. The system further includes a locking mechanism attached to the mounting device. The locking mechanism is configured to secure the mounting device to the rail of the firearm. There is thus provided, in accordance with the present invention, a quick-release mounting device for mounting an accessory such as, for example, a front sight, to a firearm.

In one aspect, the accessory may include a high-powered scope, night vision sight, or other sight or sighting accessory. The accessory sits on top of the gun barrel or the rail mount. The goal is to provide a quick-release mechanism that will not jam up when it gets dirty or is subject to extreme conditions such as hot or cold.

In another aspect of the present invention, the mounting device comprises a base and a frame coupled together by way of a connecting rod or yoke. The frame and base are preferably spring biased with respect to one another so as to accommodate rails of varying size therebetween. The system preferably further comprises a locking mechanism comprising a lever with an integrally disposed button. The locking mechanism is configured to be selectively in communication with a cam member having a notch on a surface thereof.

In yet another aspect of the present invention, a mount for a firearm comprises a two-piece mounting device having a base and a frame coupled to one another and having a bottom cavity designed to receive a rail of a firearm therebetween. In addition, a lever mechanism is provided for adjusting the distance between the frame and the base to thereby accommodate varying rail sizes therebetween.

In still another aspect, a mounting device for receiving a rail of a barrel of a firearm includes a base having a downwardly facing receiving side defining a channel. A frame is coupled to the base by way of a connecting rod or yoke defining a gap therebetween and defining a second channel. The frame and base are preferably spring-biased with respect to one another. A locking mechanism comprising a cam having a notch on a surface thereof is also provided. The cam is configured to selectively receive a button disposed within a cavity of a lever to lock the base with respect to the frame.

One preferred feature of the invention is to provide an apparatus that is ruggedized and reliable, thereby decreasing down time and operating costs. Another preferred feature of the invention is to provide an apparatus that has one or more of the characteristics discussed above but which is relatively simple to manufacture and assemble using a minimum of equipment.

According to another aspect of the invention, a system for mounting an accessory to a support structure is disclosed that includes a shaft having a longitudinal axis and a head portion. A lever is connected to the head portion of the shaft and is rotatable about an axis oriented in a crossing direction relative to the longitudinal axis of the shaft. A notch is formed in the head portion of the shaft and a lock, pivotably attached to the lever, is positioned to selectively interact with the notch so that the lock prevents rotation of the lever relative to the shaft when the lock is engaged with the notch.

Another aspect of the invention discloses a quick release accessory mount system having a mount secured to a first structure. A release assembly is secured to a second structure and selectively engageable with the mount. The release assembly includes a shaft, a first clamp member and a second clamp member that are captured between alternate ends of the shaft. A lever is attached to the shaft adjacent one of the first clamp member and the second clamp member and rotatable relative to the shaft to alter a distance between the first clamp member and the second clamp member. A lock is supported by the lever and positioned to interact with the shaft to prevent rotation of the lever.

Another aspect of the invention discloses a method of forming a quick release clamp assembly that includes connecting a first clamp member and a second clamp member with a shaft. A lever is engaged with the shaft so that the lever can be rotated to alter a distance between the first clamp member and the second clamp member. A button is attached to the lever so that it is movable relative to the lever and the shaft. The button is positioned on the lever so the button can prevent movement of the lever in a first direction when the button is engaged with a notch formed on the shaft.

These and other aspects and features of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
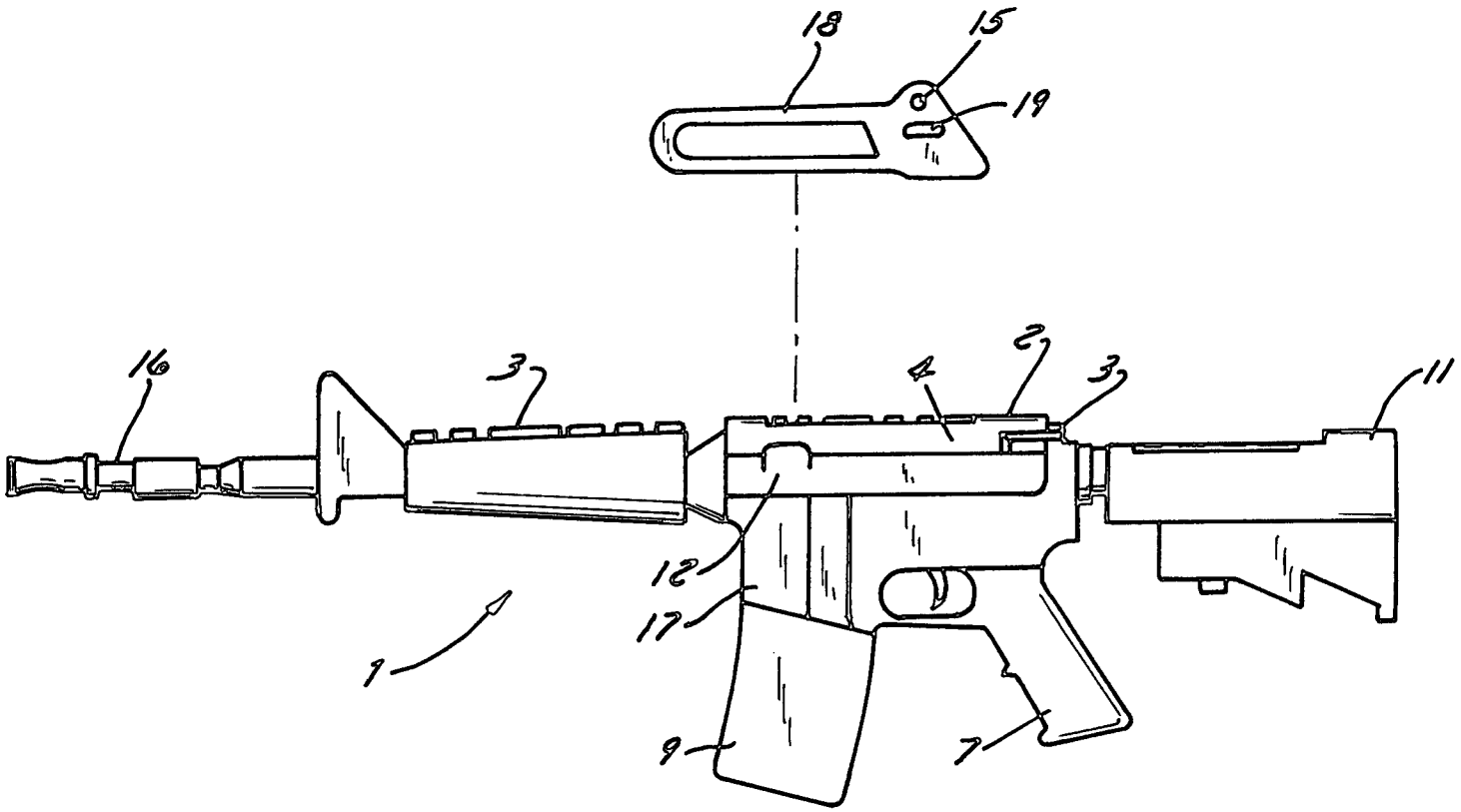
FIG. 1 is a side view of an assault rifle to which the present invention may be mounted.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected", "attached", or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The invention solves the problem of having a locking mechanism that automatically locks the scope or other accessory onto a rail mount, rail system, or other underlying support. As tolerances of the rail or support may be off, the locking mechanism of the present invention may be adjusted without the use of specialized tools to maintain a constant tension and add durability. The locking mechanism includes a cam interface that defines a separation between facing structures and a lock that allows for only selective operation of the locking mechanism. In addition to firearm applications, it is appreciated that the locking mechanism can be used for securing any of a number of accessories in in-use or stored orientations relative to vehicles or other structures.

2. Detailed Description

Referring to the drawings in detail wherein like elements are indicated by like numerals, there is shown in FIG. 1 an outline of a conventional combat firearm 1 having a conventional stock 11, upper receiver 12, lower receiver 17, barrel 16, pistol grip 7, magazine 9, and arced handle 18 is preferably joined to the upper receiver 12. The barrel 16 is also joined to the upper receiver 12, i.e., the upper receiver 12 "receives" the barrel 16. The arced handle 18 has the after part of a non-optical bead sight with windage and elevational adjustment devices 15, 19 located at the rear thereof remote from the barrel 16.

Figure 2A:
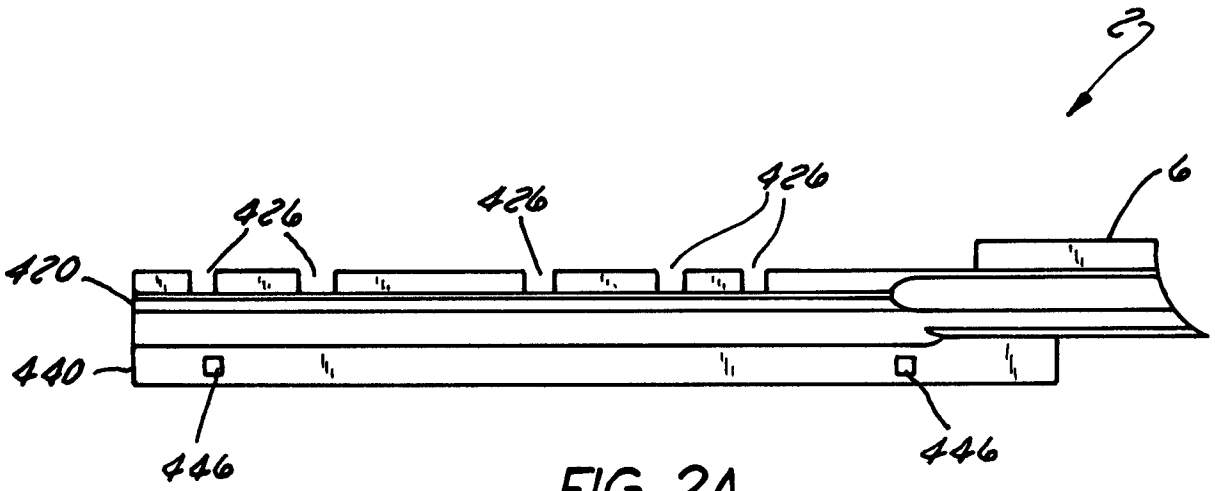
FIG. 2A is a side view of a mount of the present invention.
Figure 2B:
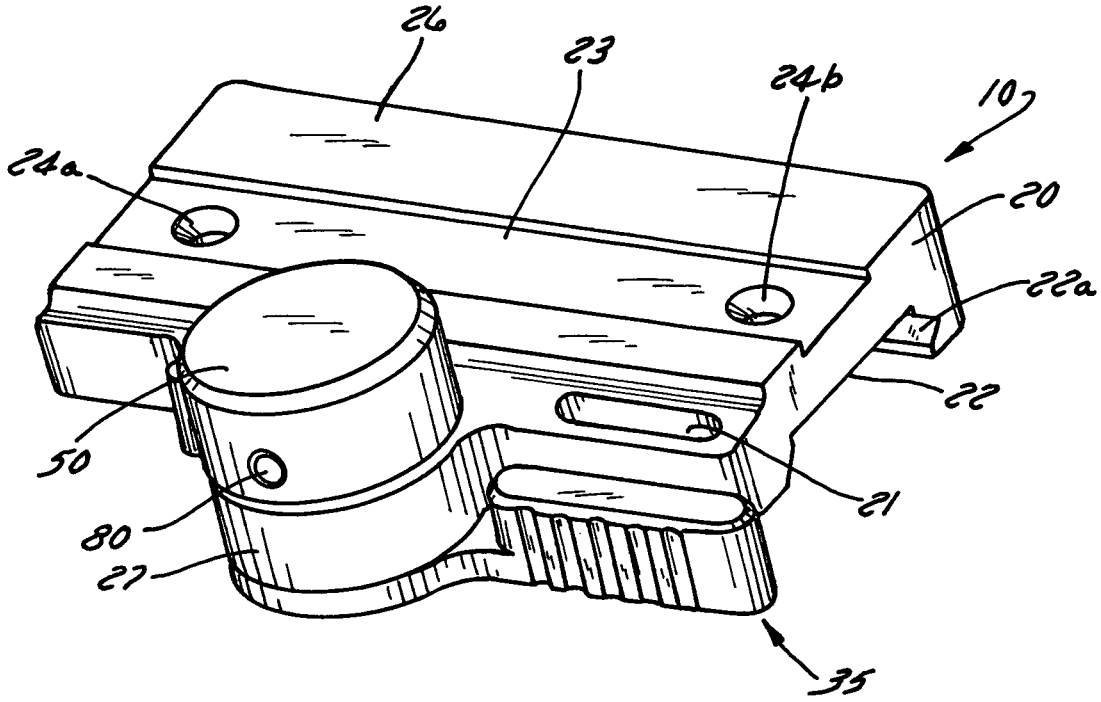
FIG. 2B is a perspective top down view of a device of the present invention which may be mounted on the mount of FIG. 2A.

FIG. 2A shows a typical receiver and mount system including a rail. As may be seen in FIG. 2A, the receiver sleeve 2 has a top section 420 and a bottom section 440 and a longitudinal axis extending in spaced, parallel relation to the longitudinal axis of the firearm 1. The top section preferably contains a rail 3. Optional notches 426 in the rail 3 provide additional means of engaging other components. The quantity and placement of pairs of notches 426 are as required or needed.

The outer transverse width of the receiver sleeve top section 420 is 0.835 inches. The dimensions of the receiver sleeve top section 420 remain the same regardless of the firearm the receiver sleeve 2 is attached to. This ensures that all modular enhancements need meet only one interface requirement, regardless of the firearm. The receiver sleeve top section 420 is joined to the receiver sleeve bottom section 440.

In the embodiment shown in FIG. 2A, the outer transverse width of the receiver sleeve top section 420 is 0.835 inches. The dimensions of the receiver sleeve top section 420 remain the same regardless of the firearm the receiver sleeve 2 is attached to. This ensures that all modular enhancements need meet only one interface requirement, regardless of the firearm. In this embodiment of the invention, the receiver sleeve 2 has pins 4 affixing it to the firearm upper receiver 12 to prevent removal from the firearm 1 by other than an official armorer. Each pin 4 passes through one of a plurality of holes 446 formed transversely through said bottom section for pinning said receiver sleeve 2 to said firearm upper receiver 12. In practice, the receiver sleeve 2 would incorporate a standard non-optical, flip up sight 6 at the rear of the receiver top section 420. Windage and elevational adjustments 15 and 19 may also be included.

The conventional firearm handle was removed in order to install the receiver sleeve 2. However, handle 18 is available for semi-permanent, non-removable installation on the receiver sleeve 2 of the present invention for firearm users who do not require optics. The handle 18 is preferably installed directly to the receiver sleeve top section 420 and also has pin holes 446 for pinning to the receiver sleeve top section 420 thereby preventing removal by anyone other than an official armorer. Another embodiment of a handle is shown in the '871 patent. This handle has two fastener devices of the '871 patent type incorporated into the handle base 15. As illustrated in the '817 patent, the handle may thereby be attached about the receiver sleeve top section 420 and used to carry the firearm 1.

FIGS. 2B, 3, 4, and 5 show one embodiment of the quick release attaching device 10 of the present invention. Here, the device 10 consists of base 20, which can receive a rail 3 of a receiver 2 attached to the barrel 16 of a firearm 1. The base 20 has a slot 21 on one edge. On a bottom side of the base 20 is a receiving cavity 22 which includes receiving cavity groove 22*a*. A top side of the base 20 has a slot or groove 23. The base also includes mounting bores 24*a* and 24*b*. Along one edge of the base is a first wall 26 which is generally straight. Opposite the first wall 26 is the second wall 27 that includes a flange 27*a* and a protrusion 27*b*. Also included in the base 20 is a lever receiving bore 28. The bore 28 is preferably countersunk so that it begins with a wider bore 28*a* and is reduced to smaller bore 28*b* as shown.

Figure 7:
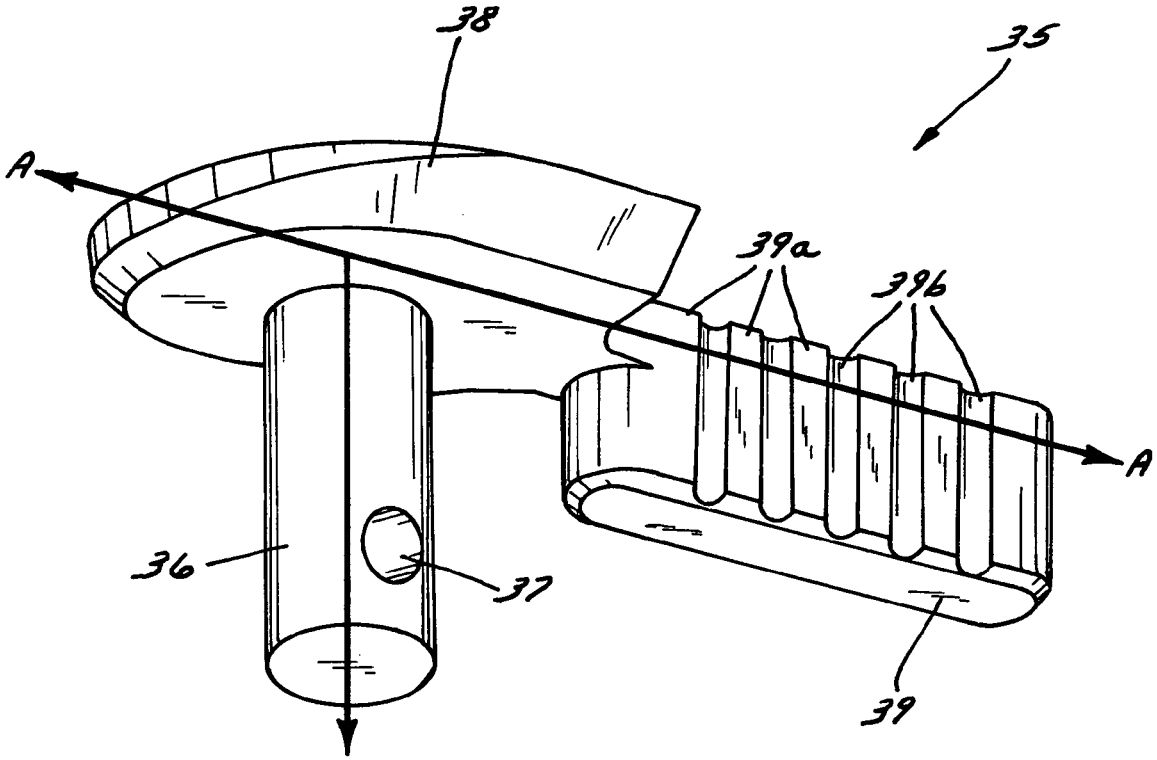
FIG. 7 is a perspective view of the lever of FIG. 3.
Figure 8:
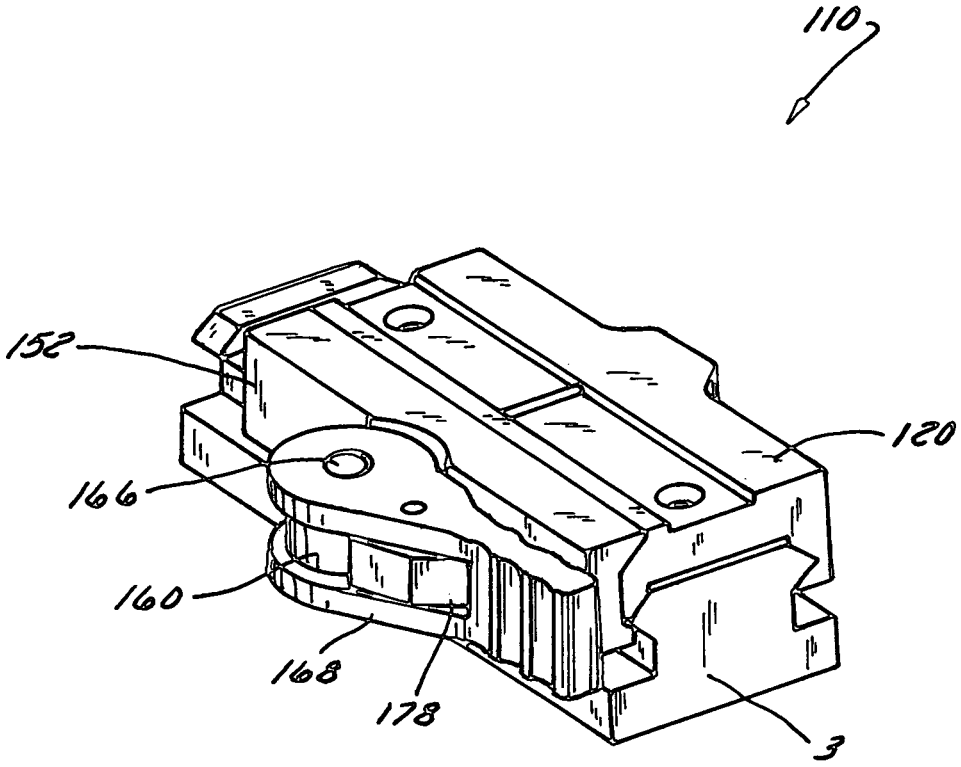
FIG. 8 is a perspective view of another embodiment of the device of the present invention.
Figure 9:
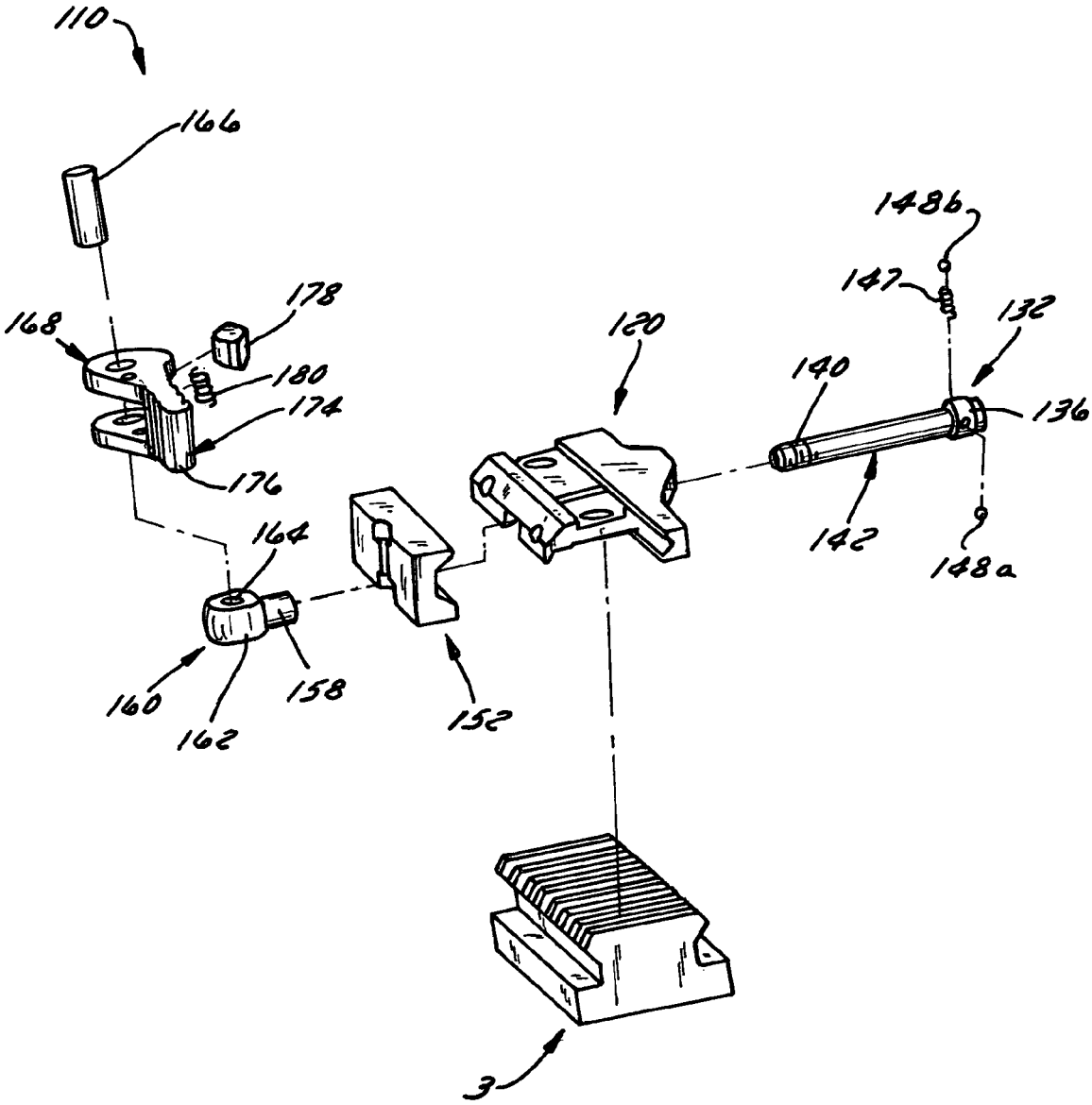
FIG. 9 is an exploded perspective view of the embodiment shown in FIG. 8.
Figure 10:
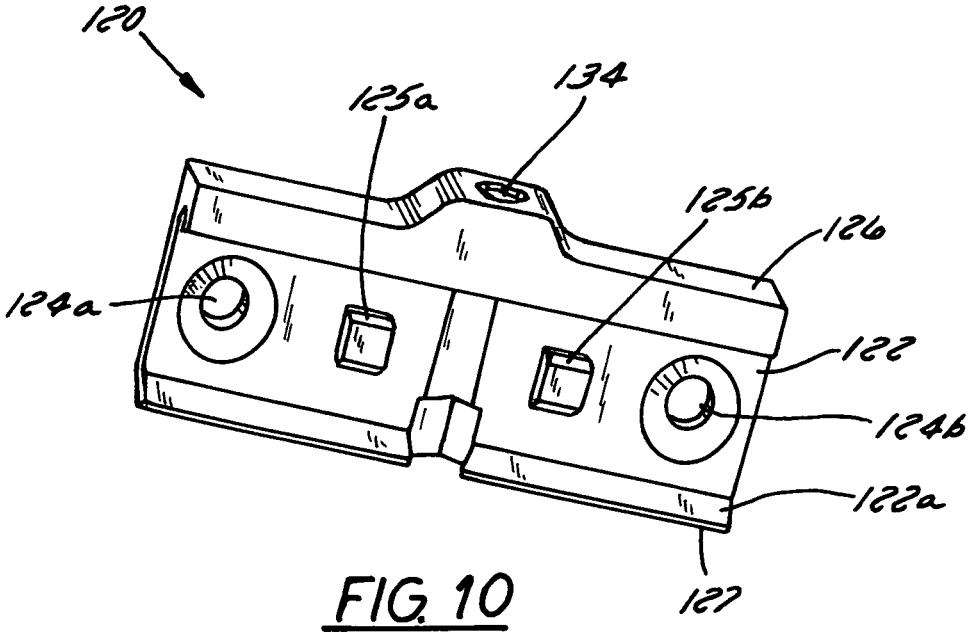
FIG. 10 is a perspective view showing the bottom of the base of the embodiment illustrated in FIG. 8.
Figure 11:
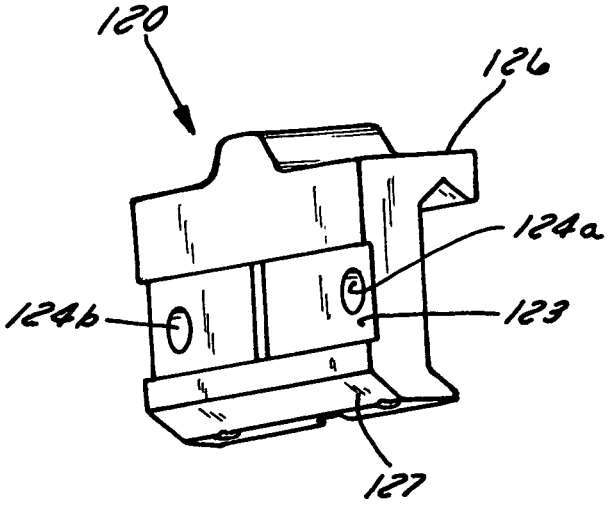
FIG. 11 is a perspective view of the top of the base of the embodiment illustrated in FIG. 8.
Figure 12:
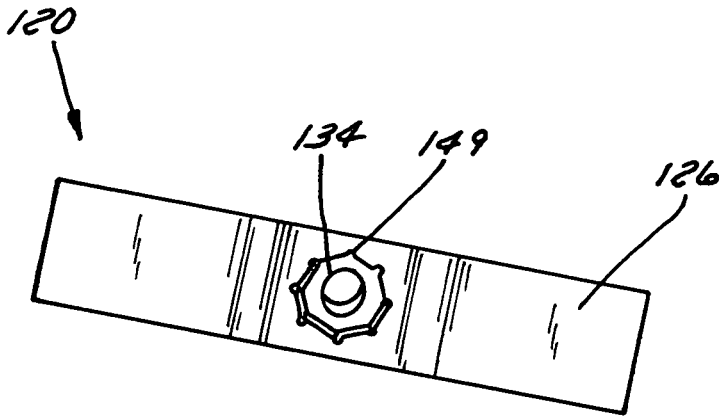
FIG. 12 is a top view of the base of the embodiment illustrated in FIG. 8.
Figure 13:
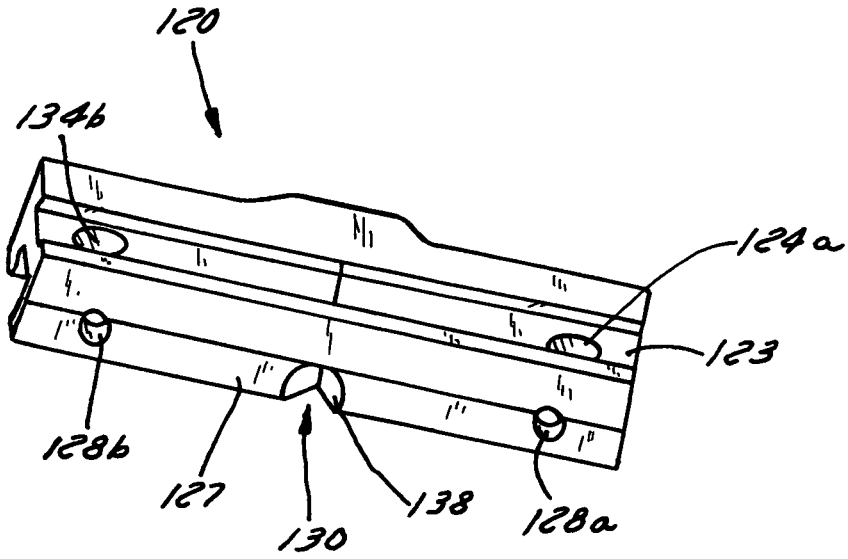
FIG. 13 is a side perspective view of the base of the embodiment illustrated in FIG. 8.

The lever 35 preferably includes a shaft 36 perpendicular to an axis A (see FIG. 7). The shaft 36 has a mounting bore 37 therethrough. The shaft 36 is attached to stand 38 that is a generally flat piece of metal. The arm 39 of the lever 35 is connected to the stand 38. The arm preferably has lands 39*a* and grooves 39*b* that add a textured surface to the arm 39. This textured surface allows for better gripping of the lever arm by a firearm operator in the field.

Figure 3:
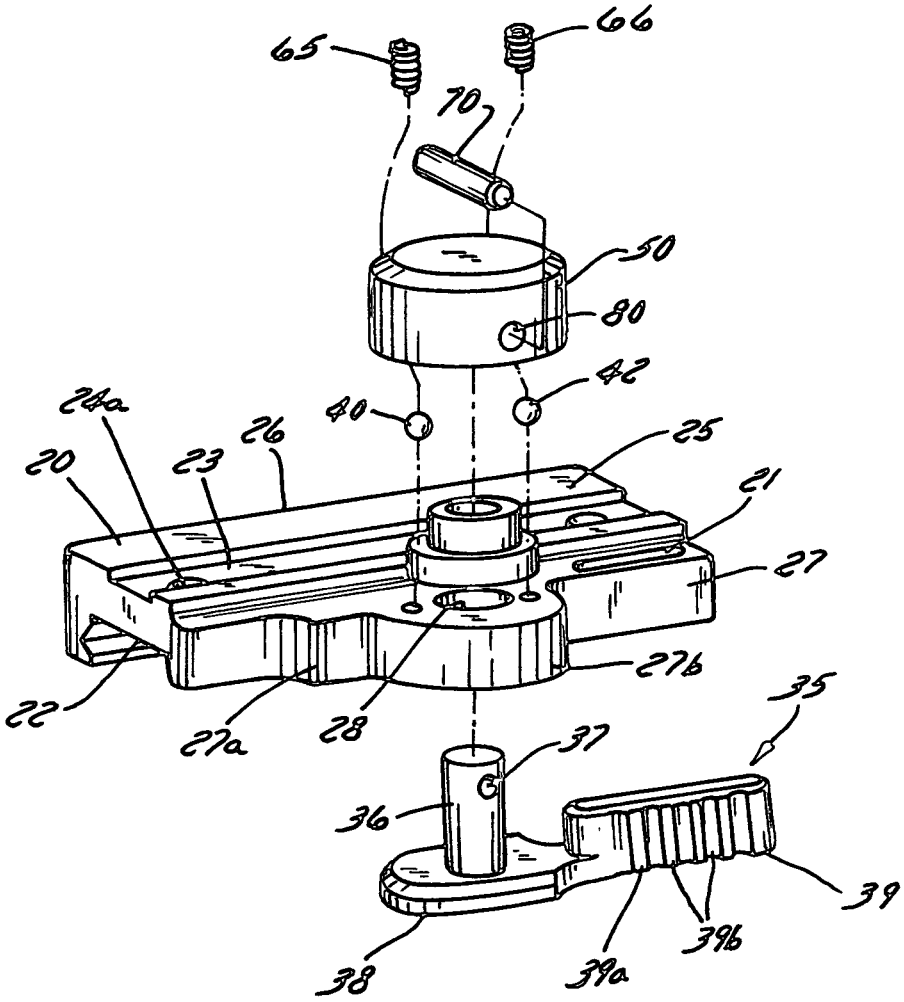
FIG. 3 is an exploded perspective top view of the device of FIG. 2B.
Figure 4:
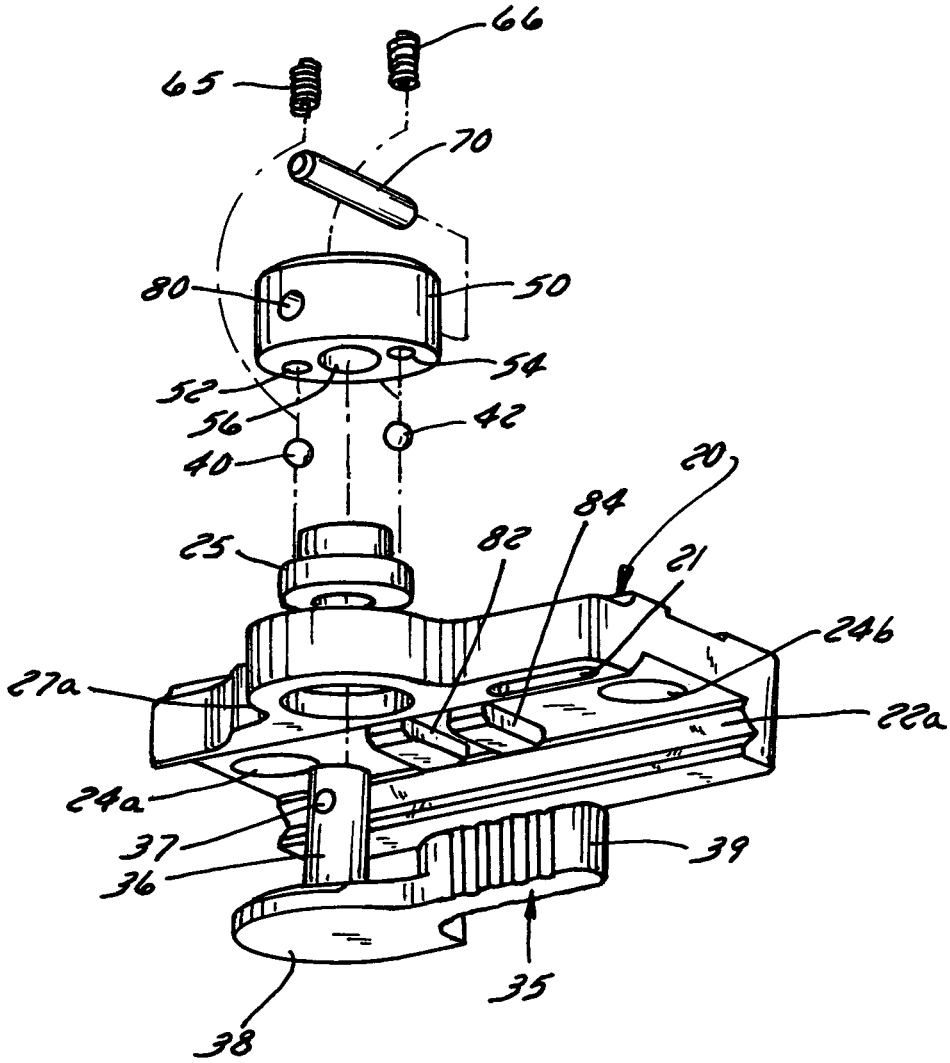
FIG. 4 is an exploded perspective bottom view of FIG. 3.

FIGS. 3 and 4 show an exploded view of device 10 of the present invention. The base 20 of the device 10 supports a washer 25, which is attached to a lever 35. Two bearings 40, 42 are operably connected to the washer 25 and the base 20. A fastening cap 50 mounts to the washer 25 on top of a shaft 36 on the lever 35. Two springs are provided in cavities 52, 54 in the fastening cap 50. The cavities 52, 54 receive springs 65, 66, which abut the bearings 40, 42. The springs 65, 66 provide a force to the bearings 40, 42, which pushes against the base 20. A hollow tube or pin roll fastener 70 fits into the cap 50 through a bore 80, which also travels through the shaft 36 and shaft bore 37 in the lever 35. Alternatively, another fastener (not shown) is provided to hold the now operably connected components in place.

FIG. 4 better shows the bottom or underside of the base 20. As shown in FIG. 4, the base 20 preferably includes a receiving groove 22*a* configured to receive a mounting rail. As also shown, on the bottom surface is a bottom first protrusion 82 and a bottom second protrusion 84. The protrusions are provided to be received into grooves in the rail when the quick release device 10 is mounted to the firearm.

Also shown in FIG. 4 is the fastening cap 50. As can be seen, a bottom side of the cap 50, preferably contains a multitude of receiving cavities. In the embodiment shown in FIG. 4, two cavities 52 and 54 are provided. A center bore 56 is provided which receives the shaft 36 of the lever arm 35.

Figure 5:
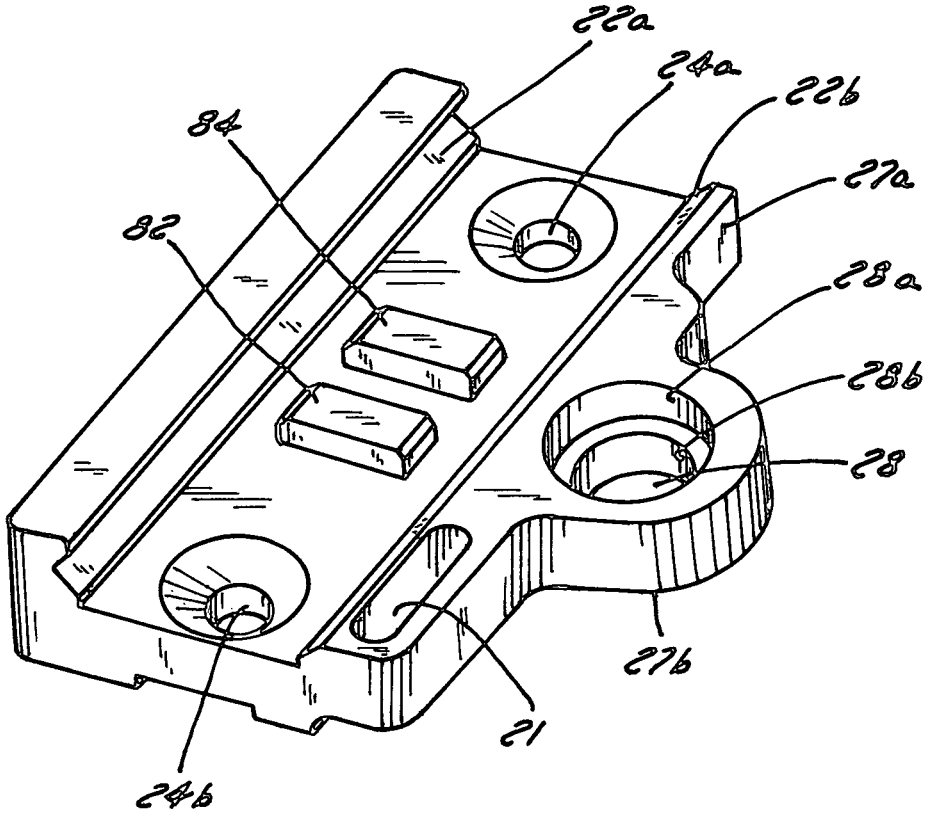
FIG. 5 is a perspective view of the base of the device of FIG. 3.

FIG. 5 shows in detail the base 20. As can also be seen, the mounting bores 24*a*, 24*b* of the base 20 may be countersunk. The orientation of the slot relative to the wall can also be better appreciated. Opposite the receiving groove 22*a* is an angled or sloping wall 22*b*. This wall 22*b* is provided to abut against the rail.

Figure 6:
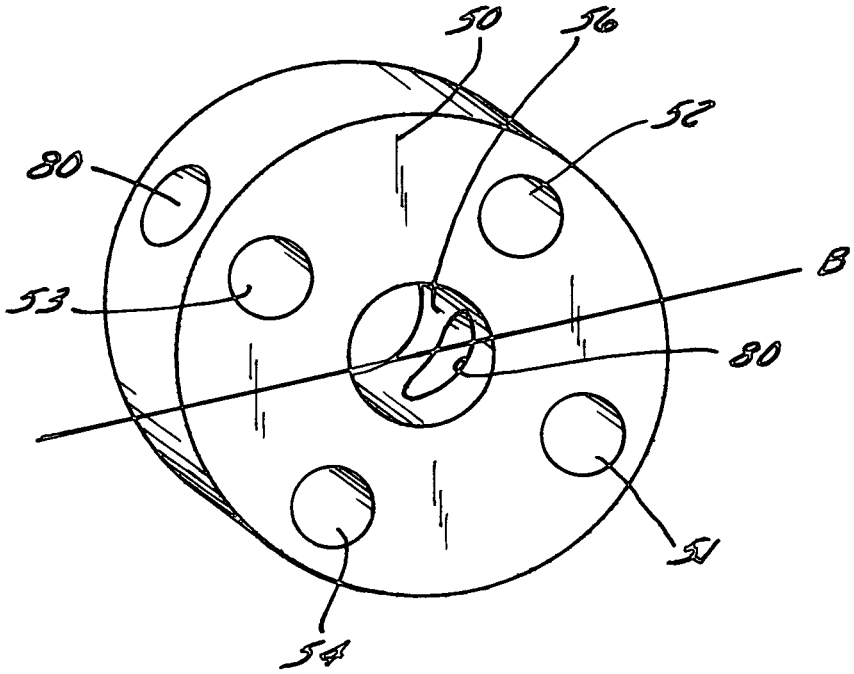
FIG. 6 is an alternative embodiment of the cap of the device of FIG. 3.

FIG. 6 shows an enlarged view of an alternative embodiment of the cap 50. In this embodiment, the cap 50 has four bearing receiving cavities 51, 52, 53, 54. As also is shown, the center bore 56 has an axis B and is surrounded by the receiving cavities. Perpendicular to the axis B is the fastening bore 80. The bore 80 passes through a first side of the cap 50, then through the center bore 56, and out a second side of the cap.

FIG. 7 is an enlarged view of the lever 35. As shown, the lever 35 preferably contains a cylindrical protrusion or mounting shaft 36 having a mounting hole 37. The mounting hole 37 receives the mounting tube 70 as it passes through hole 80 in the cap 50. The mounting tube 70 is preferably a threaded hollow Allen screw. The shaft 37 is preferably mounted to a flat piece of metal that is a stand 38 having a gradually sloping upper wall. Protruding from the stand is the arm 39. The arm 39 may have a multitude of lands 39*a* and grooves 39*b* machined or otherwise formed in a front and back surface of the arm. These lands and grooves provide an improved gripping surface for the operator.

When in use and operation, the base 20 of the present embodiment fits on a rail 3 attached to a gun 1. The device 10 is most often used to attach an accessory 18 to the gun such as a handle, night scope, light, additional weaponry, etc. Such an accessory 18 would be mounted to the top side of the base 20 on the barrel 16 or top side of the firearm 1. The bottom side of the base 20 preferably includes a receiving cavity 22 so that the base 20 can be received on the rail 3. When attaching the accessory 18 and the device 10 to the rail, the operator sets the receiving cavity 22 of the base on the rail. The lever arm 35 is then moved in a direction to effectively lock the base 20 to the rail. One key advantage is that the springs 65, 66 and bearings 40, 42 automatically adjust the device 10 for a snug fit to the rail. This is true even if different rails on different weapons are used by the operator for the same accessory. Of course, the size and shape of the rail cannot differ significantly, but must be within the required Milspec tolerances. Once the accessory 18 and a device 10 are locked in place, the operator has a greater sense of security that the accessory will not be accidentally lost. The tension or slight outward pressure applied by the ball bearings 40, 42 and the springs 65, 66 to the locking mechanism on the lever arm also helps prevent damage to the soft, but lightweight, metals typically used for the rail such as aluminum and other alloys. For example, where tolerances are very tight on prior art lever arms, the locking mechanism on such lever arms actually cuts into the rail making grooves or dents into it.

Now turning to FIGS. 8-17, and initially to FIGS. 8-13, another embodiment of the device 110 of the present invention includes a base 120 configured to receive a rail 3 of a receiver 2 attached to the barrel 16 of a firearm (not shown here). The bottom side of base 120 including a receiving cavity 122 which includes a receiving cavity groove 122*a* (See e.g., FIGS. 10 and 11). A top side of base 120 includes a slot or groove 123 running along a length thereof. The base also includes mounting bores 124*a* and 124*b*. The bottom side of base 120 further includes a pair of protrusions 125*a* and 125*b*. Along one edge of the base 120 is a first wall 126 which is generally straight. Opposite first wall 126 is the second wall 127 having a pair of recesses 128*a* and 128*b* configured to receive springs therein. Base 120 further includes a bore 130 running across the width thereof. Bore 130 is configured to receive a yoke 132 therethrough. First wall 126 includes a recess 134 for receiving the head 136 of yoke 132. Second wall 127 includes a hole 138 for receiving a threaded portion 140 of yoke 132.

Figure 14:
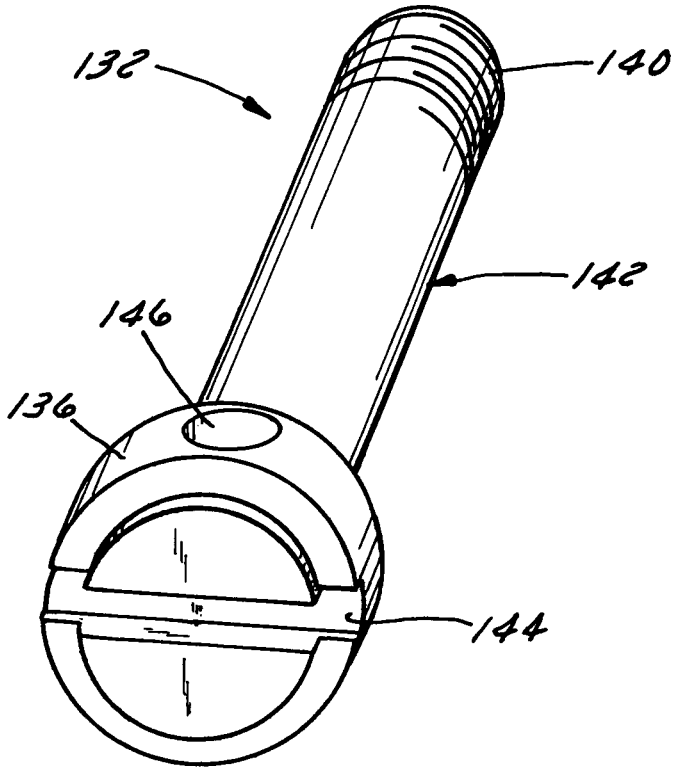
FIG. 14 is a perspective view of the yoke of the embodiment illustrated in FIG. 8.

Referring now to FIG. 14, yoke 132 is generally a connecting rod, rod or axle comprising a head 136 and a partially threaded shaft 142 having a threaded portion 140. Head 136 includes a slot or notch 144 running across the top surface thereof for receiving a tool such as, for example, a screwdriver. Head 136 further includes a bore 146 running through the center thereof. Bore 146 is configured to receiving a spring 147 therethrough and a pair of ball bearings 148*a* and 148*b* (see FIG. 9) are configured to be retained in the ends of bore 146. Further, the recess 134 of first wall 126 includes a series of detents 149 (see FIG. 12). The detents 149 are generally configured to contact portions of ball bearings 148*a* and 148*b* such that when yoke 132 is rotated, the ball bearings 148*a* and 148*b* coming into contact with detents 149 give the user audible and tactile feedback as to the relative position of yoke 132 as it is advanced or withdrawn.

Figure 15:
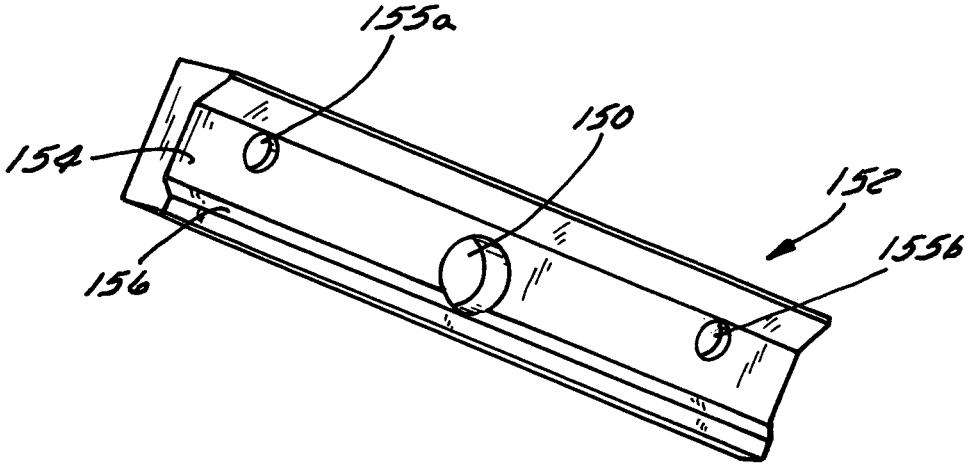
FIG. 15 is a perspective view of the frame member of the embodiment illustrated in FIG. 8.

Turning now to FIG. 15, the threaded portion 140 of yoke 132 is configured to be received through a centrally positioned bore 150 in a frame member 152 such that an end of the threaded portion 140 extends past the frame 152. Yoke 132 is thus configured to draw base 120 and frame 152 together. Base 120 and frame 152 are generally spring-biased with respect to one another by springs retained by recesses 128*a* and 128*b* of second wall 127 (see FIG. 13). A bottom surface of frame 152 defines a receiving cavity 154 having a receiving groove 156 for receiving a portion of a rail 3 of a receiver 2 attached to the barrel 16 of a firearm 1 therein. Frame 152 further includes a pair of recesses 155*a* and 155*b* configured to receive springs therein.

Referring again to FIG. 9, the end of yoke 132 is received by a threaded receiving portion 158 of a cam member 160. Threaded receiving portion 158 generally extends upwardly from the generally circular cam member 160. Cam member 160 includes a notch 162 on an outer surface thereof. Cam member 160 further includes a bore 164 through the center thereof. Bore 164 is configured to receive a dowel pin 166 or the like. Accordingly, as yoke 132 is advanced so as to bring base 120 and frame 152 closer to one another, the end of threaded portion 140 of yoke 132 eventually comes into contact with dowel pin 166 thereby limiting the advancement thereof.

Figure 16:
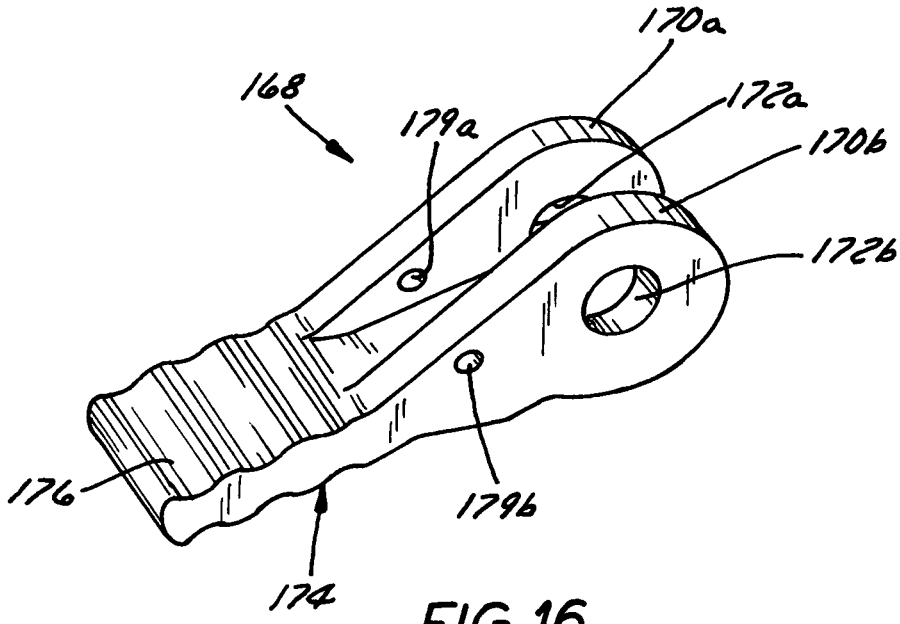
FIG. 16 is a side perspective view of the lever of the embodiment illustrated in FIG. 8.
Figure 17:
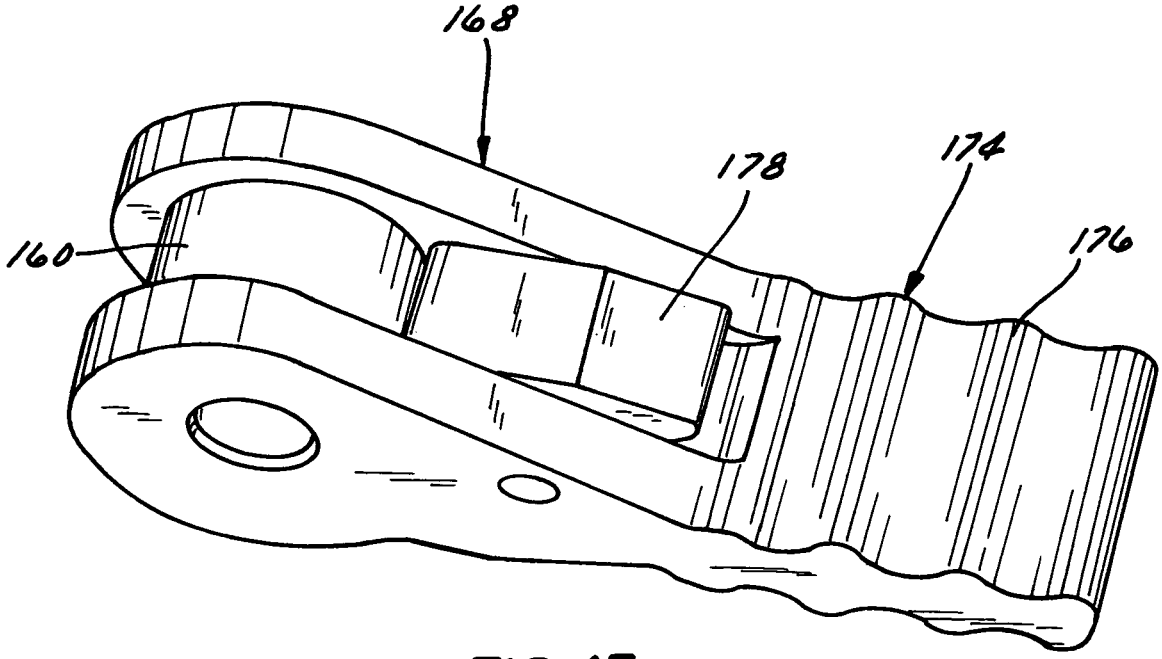
FIG. 17 is a top perspective view of the locking mechanism of the embodiment illustrated in FIG. 8.

Referring now to FIGS. 16 and 17, cam member 160 is coupled to a lever 168 having two opposing side surfaces 170*a* and 170*b* configured to receive cam member 160 therebetween. Further, the opposing side surfaces 170*a* and 170*b* include apertures 172*a* and 172*b* for receiving ends of dowel pin 166 therein. Extending from opposing side surfaces 170*a* and 170*b* is an arm 174. The arm 174 preferably includes grooves 176 that add a textured surface to the arm 174 to allow for better gripping of the lever arm 174 by the operator in the field.

Operably coupled to the lever 168 is a button 178 which is spring biased with respect to the lever arm 174 by a spring 180. Button 178 may be secured in place by a pin or the like running through a width thereof through apertures 179*a* and 179*b*. Button 178 is configured such that an end portion thereof is selectively and removably retained by the notch 162 (see FIG. 9). Accordingly, when an end of button 178 is retained in notch 162 of cam 160, the base 120 and frame 152 become locked with respect to one another. Alternatively, when adjustment of the width of base 120 and frame 152 is desired, the button 178 may be depressed such that it may be removed from notch 162 thereby allowing the arm 174 of lever 168 to swing to the opposite side thereof, thereby freeing base 120 and frame 152 to move horizontally with respect to one another. This allows the width of device 110 of the present embodiment to be adjusted to accommodate varying rail sizes. The presence of button 178 is useful in preventing accidental loosening of the device 110 in the field. Further, the lever 174 configured to allow for ambidextrous operation as the lever 174 may be rotated 180 degrees and adjusted for the particular firearm.

The width of device 110 is adjusted by turning yoke 132 to draw base 120 and frame 152 closer to one another or to separate base 120 and frame 152 from each other. Preferably, the device 110 of the present invention comprises eight different predetermined positions. The tactile and audible feedback generated by the contacting of ball bearings 148*a* and 148*b* and detents 149 alerts the user to the relative position of the device 110. Preferably, this embodiment of the present invention provides a user with significant adjustability. Further, the present embodiment provides even pressure distribution between the device 110 and rail 3 thereby limiting the marring of the rail 3 often created by poor-fitting connections.

Turning now to FIG. 18-21, the device 110 of the present invention is shown coupled to a rail 3 and having an accessory mount 182 attached thereto. When in use and operation, the base 120 of the present embodiment fits on a rail 3 attached to a firearm 1. The device 110 is most often used to attach an accessory 18 to the firearm 1 such as a handle, night scope, light, additional weaponry, etc. Such an accessory 18 would be mounted to the top side of the base 120 on the barrel 16 or top side of the firearm 1. The bottom side of the base 120 preferably includes a receiving cavity 122 (see FIG. 10) so that the base 120 can be received on the rail 3. When attaching the accessory 18 and the device 110 to the rail, the operator sets the receiving cavity 122 of the base 120 on the rail 3. The lever arm 174 (see FIG. 9) is then moved in a direction to move the base 120 and frame 152 together to effectively clamp and lock the base 120 to the rail 3.

Figure 18:
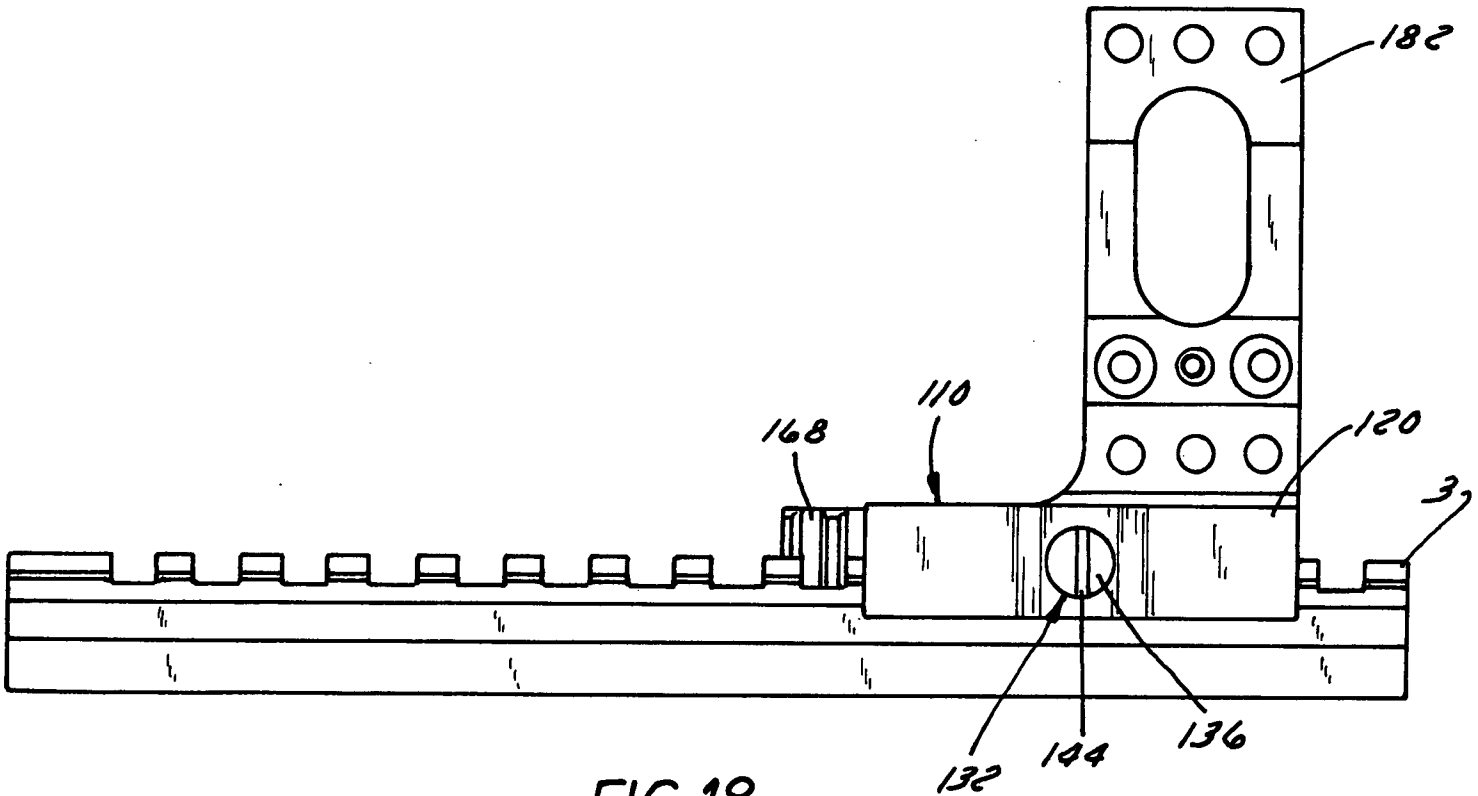
FIG. 18 is a side view of the device of the present invention mounted to a firearm rail and having an accessory mount attached thereto.
Figure 19:
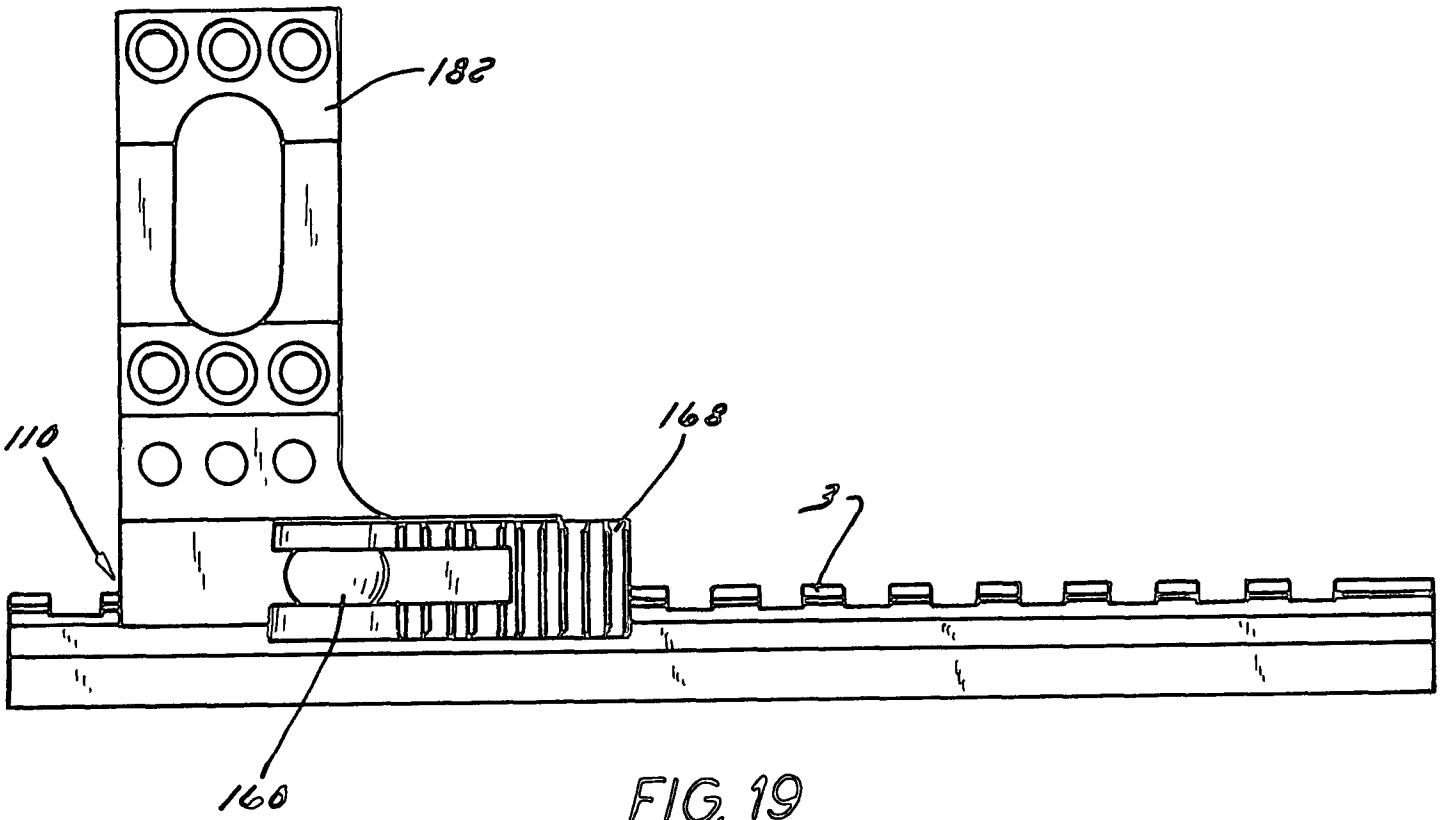
FIG. 19 is a side view of the device of FIG. 18 shown from the opposite side.

Now referring to FIGS. 18 and 19, the device 110 of the present invention is shown coupled to rail 3. The bottom side of base 120 is secured around rail 3 and locked into place by way of the cam 160 and yoke 132 mechanism, as described previously. Accessory mount 182 is coupled to an upper surface of base 120 and secured in slot groove (not shown) by way of screws or other such fasteners via mounting bores (not shown).

Figure 20:
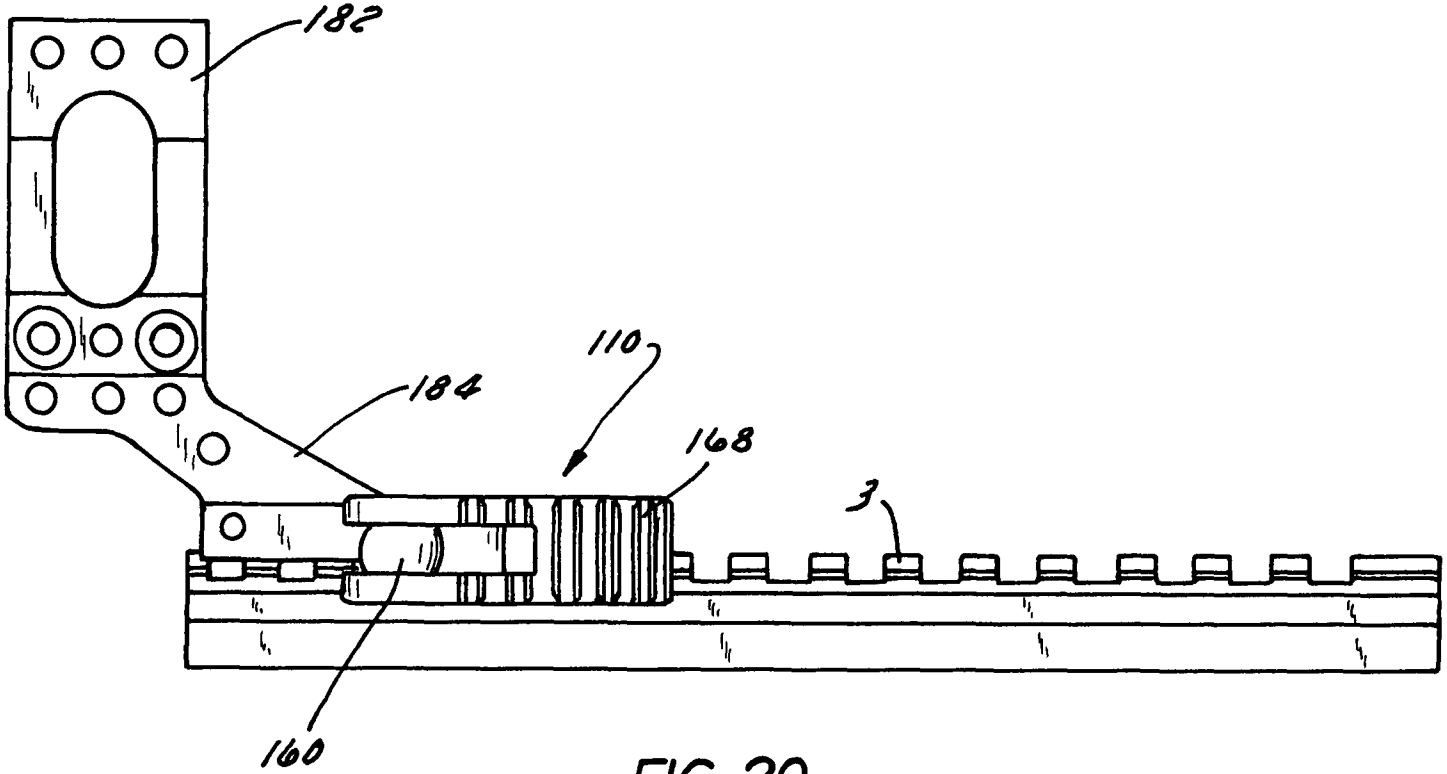
FIG. 20 is a side view of the device of the present invention having an extendible accessory mounted thereto.

Turning now to FIG. 20 an alternative embodiment is shown wherein accessory mount 182 comprises an extendible arm 184 for selectively positioning the accessory to be mounted to device 110.

Figure 21:
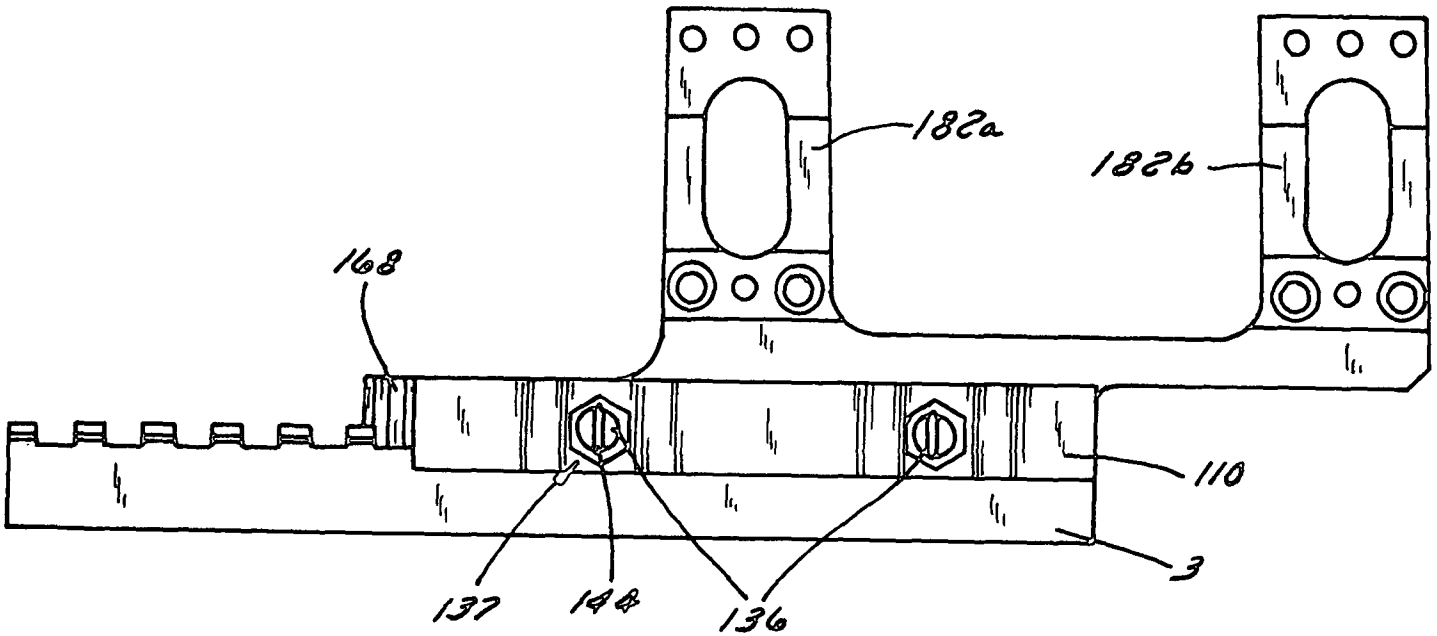
FIG. 21 is a side view of another embodiment of the device of the present invention mounted to a firearm rail and having an accessory mount attached thereto.

Referring to FIG. 21, yet another embodiment is shown wherein two devices 110 of the present invention are coupled to rail 3 to accommodate the mounting of an elongated accessory mount 182*a* and 182*b*. Preferably, the present invention may be modified to accommodate a plurality of different accessories mounted thereto.

Figure 22:
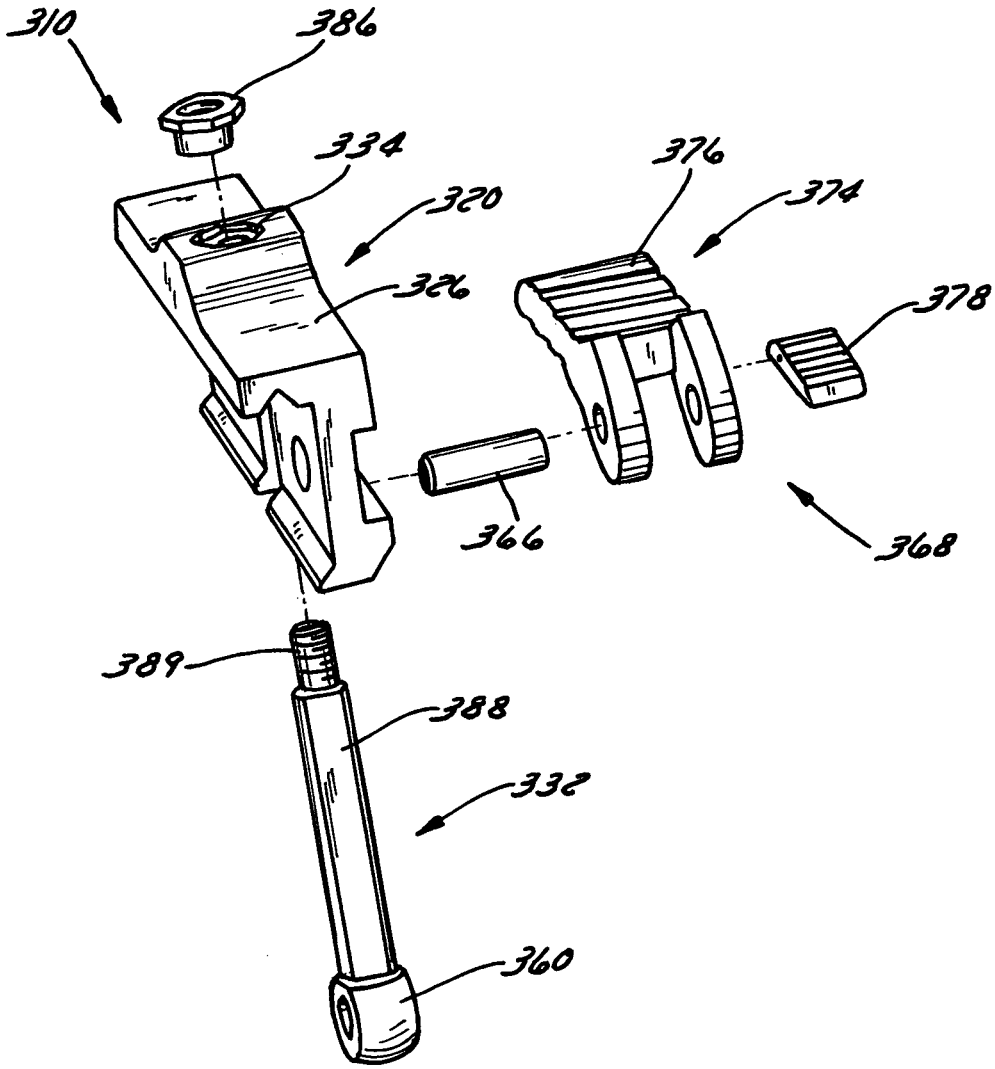
FIG. 22 is a perspective view of a portion of another embodiment of the mount of the present invention.
Figure 23:
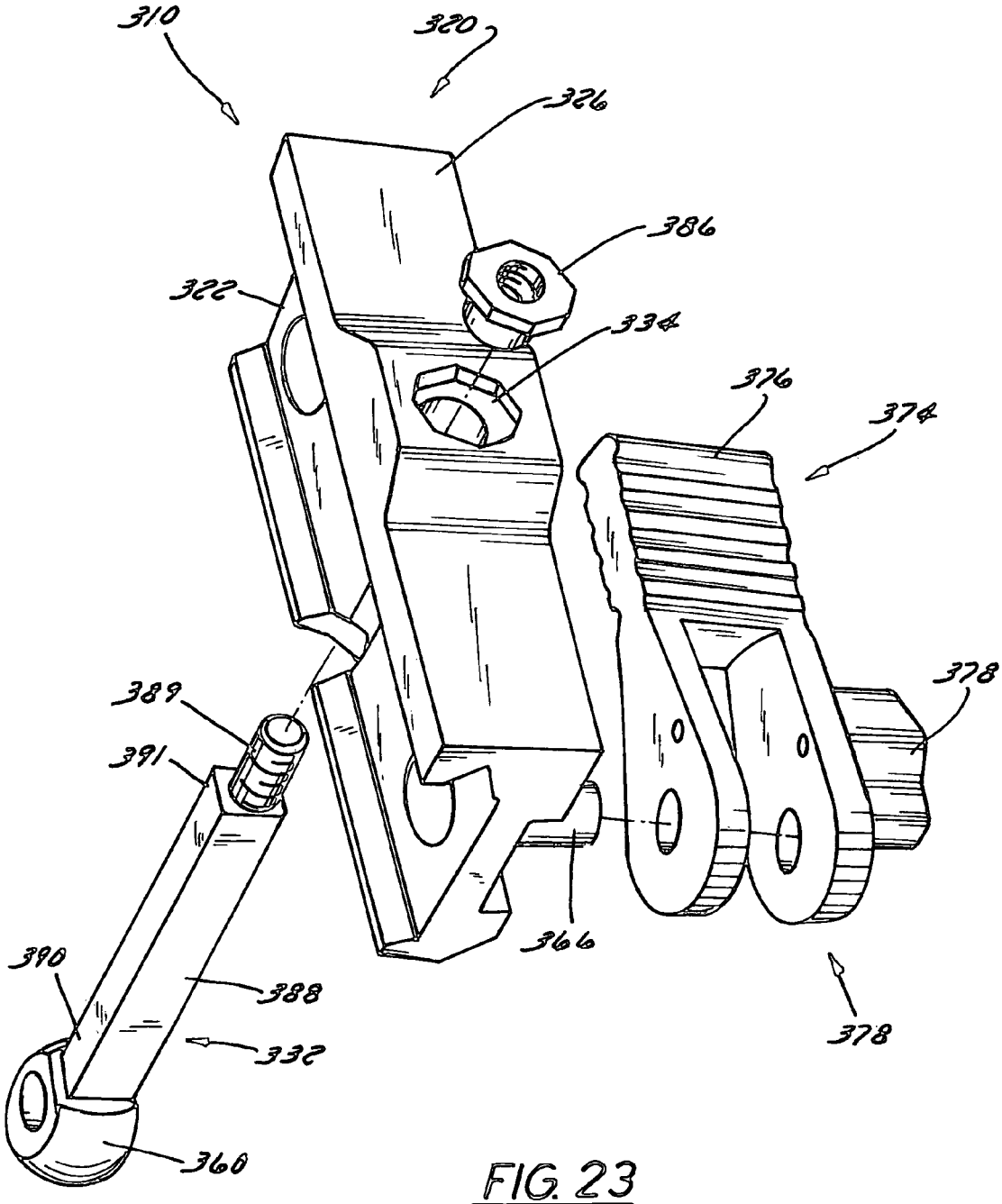
FIG. 23 is a perspective view of the device of FIG. 22 shown from another side.
Figure 24:
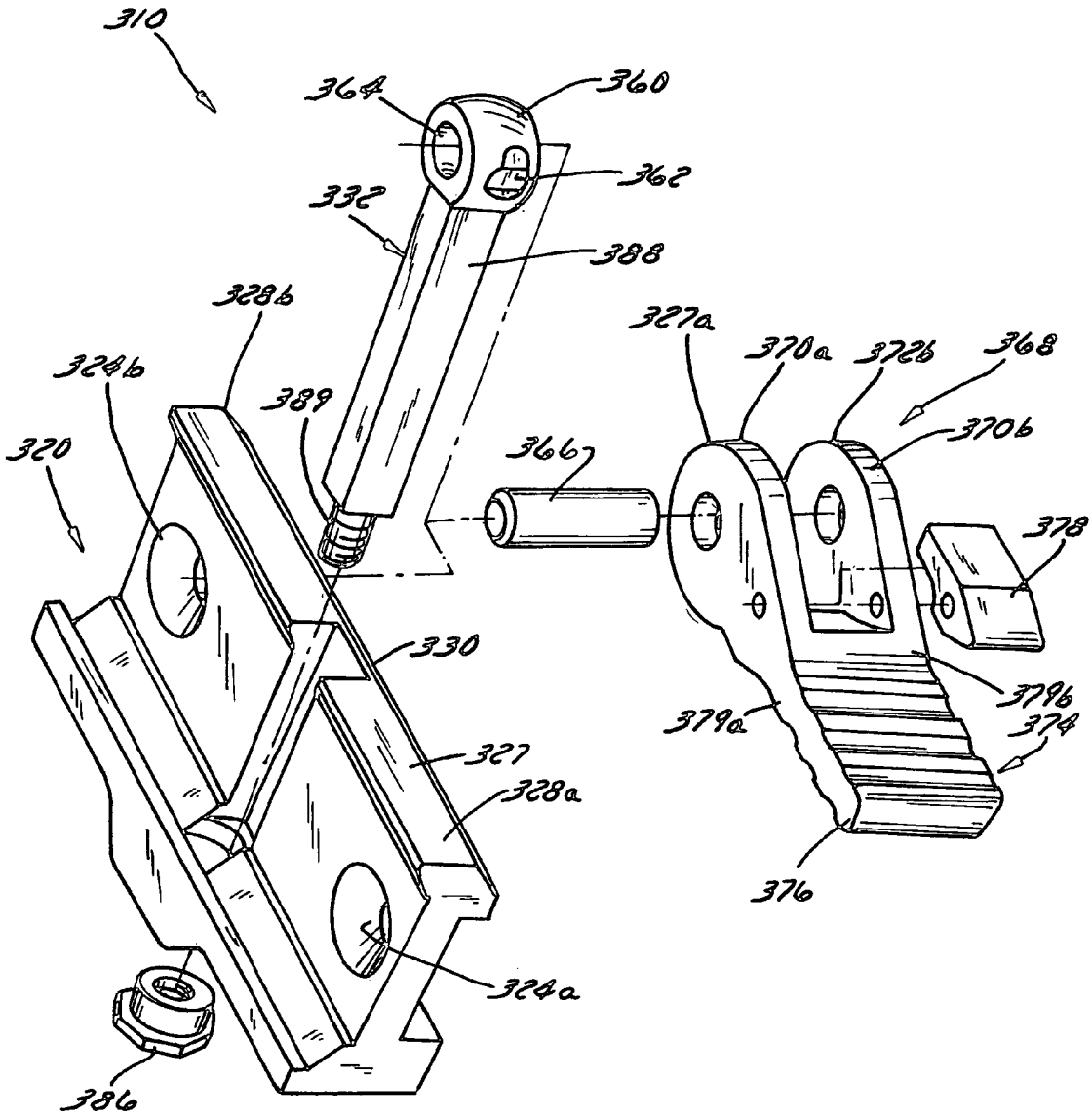
FIG. 24 is a perspective view of the device of FIGS. 21-22 shown from another side thereof.

Turning now to FIGS. 22-24, another embodiment of the device 310 of the present invention includes a first clamp member or base 320. In the embodiment shown, base 320 is configured to receive a rail of a firearm. The bottom side of base 320 includes a receiving cavity 322 configured to receive the rail therebetween. The base further includes a pair of mounting bores 324*a*, 324*b*. Along one edge of base 320 is a first wall 326 which is substantially straight. Opposite first wall 326 is a second wall 327 having a pair of recesses 328*a*, 328*b* configured to receive compression members such as springs therein. Base 320 may further include a pair of protrusions (not shown) similar to protrusions 82, 84 of a prior embodiment of the present invention. Base 320 further includes a bore 330 running across its width and configured to receive a shaft or yoke 332 therethrough.

Yoke 332 may comprise either a one-piece or two-piece yoke. The two-piece yoke embodiment, 332, may comprise an outer shaft or rod 388 which houses an inner shaft or rod 389. Outer rod 388 is preferably a steel squared shaft. Outer rod 388 comprises lower end 390 and upper end 391 from which inner rod 389 extends. Inner rod 389 is preferably threaded and has a first end configured to be received by threaded receiving portion (not shown) of a cam surface or head 360, and a second end is configured to be received by a locking nut 386. Alternatively, the rod may be a single rod with threaded portions. In one embodiment, the rod is configured to replace the protrusions (e.g., 82, 84) and fit into grooves or notches 26 in the rail 3 (FIG. 1).

Nut 386 preferably comprises an internally threaded receiving nut having a centrally located opening running through the center thereof for receiving the threaded inner rod 389. Nut 386 is preferably beveled so as to be received by a generally frustoconically shaped recess 334 located in the first wall 326 of base 320. The frustoconical shape of nut 386 provides for better force distribution to yoke 332 and nut 386, thereby preventing sheering. Nut 386 may be secured by hand, or alternatively, it may have a slot on an upper surface for receiving a screwdriver or similar such tool.

Yoke 332 is preferably a connecting rod or similar such connector and couples base 320 to a second clamp member or frame member 152 (FIG. 8) that is spring biased with respect to base 320, as in the previous embodiments of the device 310. The frame member of the present embodiment may comprise a frame member similar to those of the previous embodiments. Alternatively, the base member and the frame member can have other shapes that are configured to cooperate in a clamping manner with structures other than rail 3 and structures having different shapes than rail 3. Yoke 332 is configured to selectively adjust the width of the device 310 by advancing the threaded inner rod 389 toward side 326 of base 320 to draw the base 320 and frame member closer to one another or, alternatively, extending the distance between the base 320 and the frame member by advancing the yoke toward side 327 of base 320.

Head 360 of yoke 332 includes a notch 362 on its outer and a bore 364 extending through the center thereof. Bore 364 of head 360 is configured to receive a dowel pin 366 or similar such connector. Head 360 is coupled to a lever 368 having two opposing sides 370*a*, 370*b* that are configured to receive head 360 therebetween. Sides 370*a*, 370*b* further include apertures 372*a*, 372*b* configured to receive the ends of dowel pin 366. Apertures 372*a*, 372*b* are eccentric with respect to sides 370*a*, 370*b*. An arm 374 extends from the sides 370*a*, 370*b*. Arm 374 includes grooves 376 over the surface thereof. Grooves 376 are configured to provide the user with a textured surface to allow for improved gripping of the lever arm 374 during operation. As described further below, rotation of arm 374 about pin 366 alters the distance between frame member 152 and base 320 due in large part to the eccentric orientation of the pin 366 relative to sides 370*a*, 370*b* of lever 368. It should be readily appreciated that rotation of lever 368 about pin 366 generates substantially linear motion in a direction generally aligned with shaft 388 between frame member 152 and base 320.

A lock or button 378 is pivotably coupled to lever 368 and spring biased with respect thereto by a spring or other such compression member (not shown). Button 378 may be secured in place by a pin or other such connector running through a pair of apertures 379*a*, 379*b* disposed in the sides 370*a*, 370*b* of lever 368 respectively. Button 378 is configured such that an end portion of button 378 selectively and removably engages a notch 362 formed on head 360. When the end of button 378 is engaged with notch 362 of head 360, the base 320 and frame member become locked with respect to one another. Said in another way, the distance between first and second clamp members 152, 320 is fixed when button 378 is engaged with notch 362. The button 378 may be selectively removed from notch 362 of head 360 by depressing the button 378 to thereby free the base 320 with respect to the frame member 152. Rotation of lever 368 about pin 366 provides a repeatable "open" and "closed" orientation of the first and second clamp member 152, 320 along yoke 332. Rotation of lock 378 into and out of engagement with notch 362 provides a "locked" and "unlocked" arrangement of lever 368. Said in another way, lever 368 cannot rotate about pin 366 until lock 378 is disengaged from notch 362 of head 360 of yoke 332. The distance between the first clamp member or base 320 and the second clamp member or frame member 152 associated with the "open" and "closed" orientation of the first and second clamp member 152, 320 can be selectively adjusted by advancing yoke 332 in a particular direction to accommodate rails or other support structures of varying size.

The operating width of device 310, or the width associated with the "open" and "closed" orientation of the first and second clamping members, is adjusted by turning yoke 332 to either draw the first clamp member or base 320 and the second clamp member or frame member 152 closer to one another or to separate them from each other. The device 310 of the present embodiment preferably comprises a plurality of different predetermined positions or widths thereby allowing the device 310 to accommodate a wide variety of rail or other support types/shapes. Preferably, the device 310 of the present embodiment is configured such that the selection of the predetermined positions is done without audible feedback, thereby allowing a user to advance on a target and adjust a sight or other such device without alerting the target.

In one embodiment, the device 310 of the present invention may be configured to receive a Tangodown™ grip handle, or other similar device. A Tangodown™ handle may be mounted on any accessory rail. The Tangodown™ handle has an H-shaped cavity configured for receiving protrusions of base 320. The Tangodown™ handle may then be secured with a locking bolt disposed between the protrusions of base 320 and configured to be secured to the center of the handle. The base may be rounded to better conform to the shape of the grip and to eliminate sharp edges.

The devices 10, 110, and 310 and its components are typically fabricated from a relatively strong, lightweight material such as, for example, aluminum. For example, the devices 10, 110, and 310 of the present invention may be constructed from 6061 anodized aluminum hardcoat or 17-4 stainless steel. It is possible, however, to construct devices 10, 110, and 310 from other such materials including both metals and plastics having similar characteristics. Further, the devices 10, 110, and 310 are fully adjustable so as to fit rails 3, or other support structures, of varying size as well as those that have become worn as they comprise a relatively large contact area without causing damage thereto.

Figure 25:
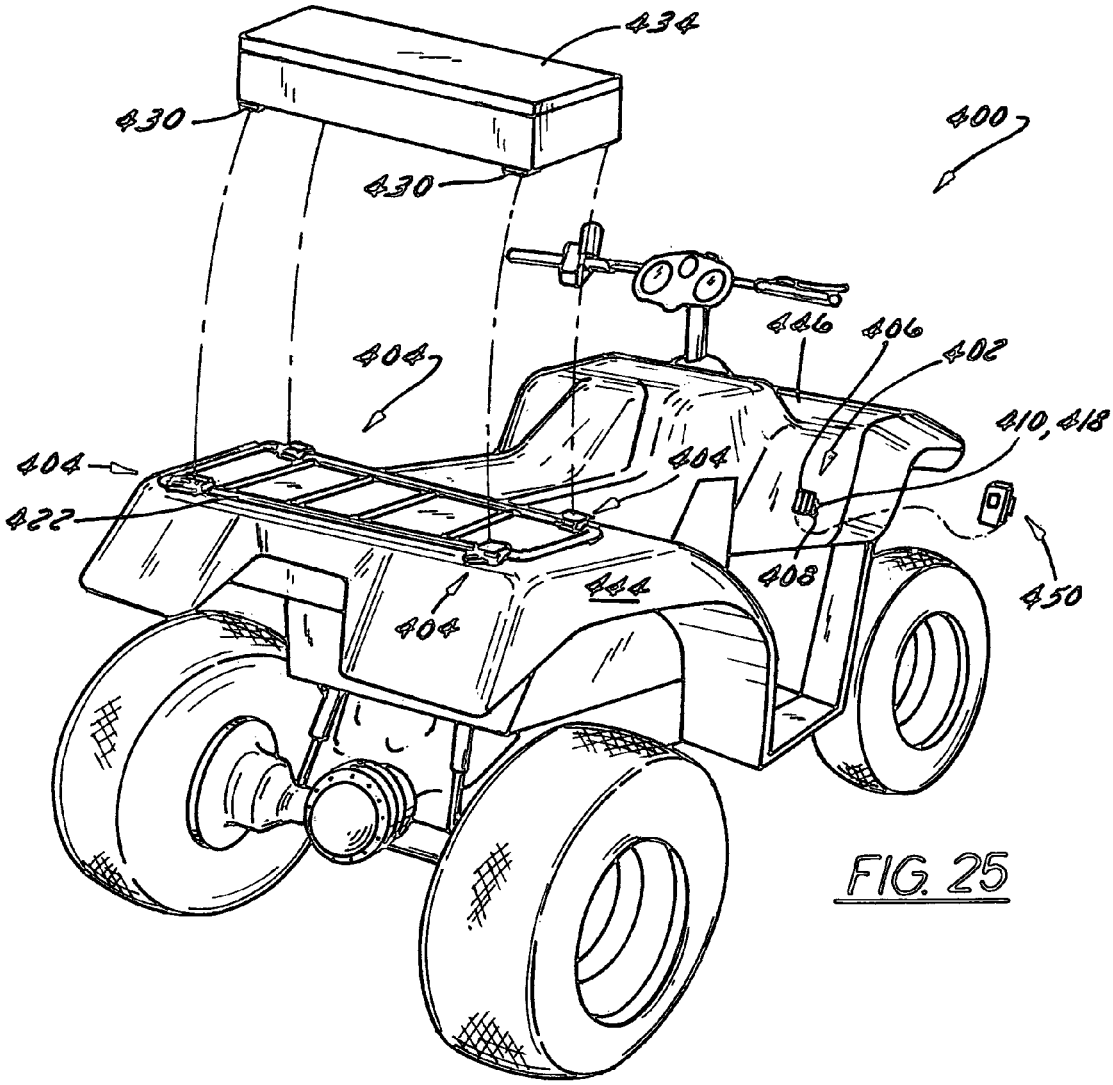
FIG. 25 is a perspective view of an exemplary vehicle such as an all-terrain vehicle (ATV) equipped with a number of accessory mounting systems according to the present invention.
Figure 26:
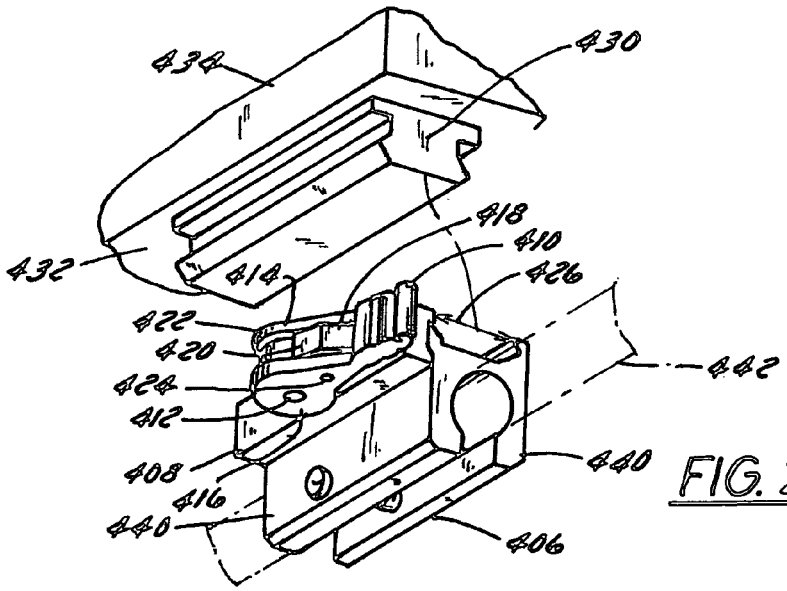
FIG. 26 is a detailed view of one of the container accessory mounting systems shown in FIG. 25.

FIGS. 25-33 show various other uses, configurations, and orientations for accessory mounting systems according to the present invention. Referring to FIGS. 25 and 26, an all-terrain vehicle (ATV) 400 is equipped with a number of accessory mounting systems 402, 404 according to the present invention. Although ATV 400 is shown as what is commonly understood as a "four-wheeler", it is appreciated that accessory mounting systems 402, 404 of the present invention are usable with other on and off road vehicles such as three-wheelers, amphibious vehicles, on road and off road utility vehicles (UTV's), golf carts, motorcycles, recreational vehicles (RV's), campers, bicycles, trucks, cars, police vehicles, fire vehicles, other emergency response vehicles such as ambulances, etc. As described further below, with respect to FIG. 30, it is further appreciated that the present invention is also usable with vehicles used for air travel such as airplanes, gliders, para-sails, etc. as well as water based vehicles such as boats, canoes, personal watercraft, etc. It is envisioned that the present invention can be used in any application requiring removable secure supporting of separable components.

Referring to FIGS. 25 and 26, each accessory mount system 404 includes a first clamp member 406 and a second clamp member 408 that movably cooperate with one another as a function of a position of a lever 410 and a length of a connecting shaft as described further below. Similar to the assembly discussed above with respect to FIGS. 21 through 24, lever 400 is attached system 404 by a pivot pin 412 that cooperates with a shaft (not visible) that connects first clamp member 406 and second clamp member 408. Pivot pin 412 is eccentrically engaged with the opposite arms 414, 416 of lever 410. A lock 418 is positioned between arms 414, 416 of lever 410 and engages a notch 420 formed in a head portion 422 of the connecting shaft. A pivot pin 424 pivotably connects lock 418 to lever 410. Operation of lever 410 and lock 418 is generally similar to that described above with respect to the previous embodiments.

As described above, manipulation of lever 410 alters a distance, indicated by arrow 426 between first clamp member 406 and second clamp member 408. A cooperating or securing structure, such as a rail 430 is attached to an underside 432 of an accessory, such as a container 434. Rail 430 is constructed to pass between first clamp member 406 and second clamp member 408 when lever 410 is oriented in an open position and to be snugly captured therebetween when lever 410 is rotated to a closed position. First clamp member 406 includes a pair of optional sidewalls 440 that are constructed to be secured to an underlying structure, such as a fender luggage rack 442 of vehicle 400. It is appreciated that rack 442 can be secured to either of a rear fender assembly 444 or a front fender assembly 446 of ATV 400. It is further appreciated that accessory mount system 404 could be secured to the underside of container 434 and configured to directly engage rack 442 thereby omitting rail 430. It is appreciated that distance 426 between first clamp member 406 and second clamp member 408 be shaped and sized so as to slidably cooperate with rack 442 when lever 410 is oriented in an open position and snugly and clampingly engage a rack 442 or other structure of vehicle 400 when lever 410 is rotated to a closed position.

Regardless if accessory mounting system 404 is supported by the accessory or the supporting structure and regardless if the mounting structure engages a rail or directly connects the accessory and the underlying support structure, system 404 includes lock 418 which prevents the unintended or undesirable rotation of lever 410 toward an open position and thereby prevents the unintended separation of the accessory from the underlying support. Accordingly, mounting system 404 provides a robust but severable and securable connection for securing accessories, such as a container 434, to a supporting structure, such as a vehicle, such as a four-wheeler or ATV 400. It is further appreciated that, wherein system 404 is secured to the vehicle rather than to the accessory, that one or more accessories and can selectively engaged with a given mounting system 404. That is, one or more of accessory mount systems 404 could be configured and positioned to directly engage a firearm, a firearm support such as a gun rack, and/or other utility boxes or containers which may be configured for specific applications. For instance, in a ranching application, one user may have one container 434 whose contents are associated with fence mending and another container whose contents are associated with a different task. Simply replacing the container quickly outfits the underlying machine for the task at hand without requiring the unpacking and repacking of the container with the tools/accessories associated with each task. Although container 434 is shown as what is commonly referred to as utility box, is appreciated that container 434 may have a more collapsible configuration such as a fabric or canvas bag or the like.

Figure 27:
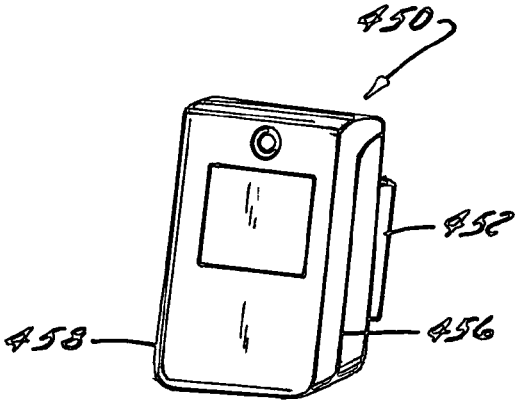
FIGS. 27 and 28 are perspective views of opposite sides of an electronic accessory equipped with a rail portion that removeably cooperates with an accessory mounting system shown in FIG. 25.
Figure 28:
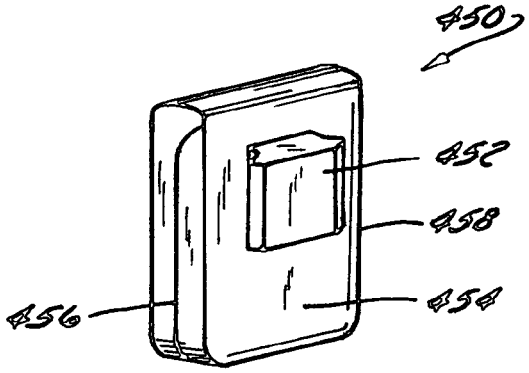

Unlike accessory mounting systems 404, accessory mounting system 402 is positioned forward relative to an operator seated upon ATV 400. Accessory mounting system 402 also includes a first clamp member 406, a second clamp member 408 and a lock and lever and lever 410, 418 similar to that described above. An electronic accessory, such as a cell phone 450, is adapted to removably cooperate with accessory mounting system 406. As shown in FIGS. 27 and 28, cell phone 450 includes a rail 452 that is secured to a backside 454 thereof. Rail 452 may be permanently or removably, such as with a robust hook and loop fastener system, attached to cell phone 450. Alternatively, rail 452 may be formed as an integral part of phone 450. Alternatively, alternate lateral sides 456, 458 of cell phone 450 could be configured to directly engage the cavity between first clamp member 406 and second clamp member 408 of accessory mounting system 402. As yet another alternative, a dampening media can be placed between clamp members 406, 408 and shaped to compress about the phone 450 when system 402 is locked thereabout. Although electronic accessory 450 is shown is what is commonly understood as a cell phone, it is appreciated that system 402 could be constructed to cooperate with other electronic devices such as one or more of a GPS system, an electronic rangefinder, lights or flashlights, speakers, video equipment, a camera, personal computers or PDA's, televisions, and/or other electronic devices.

Figure 29:
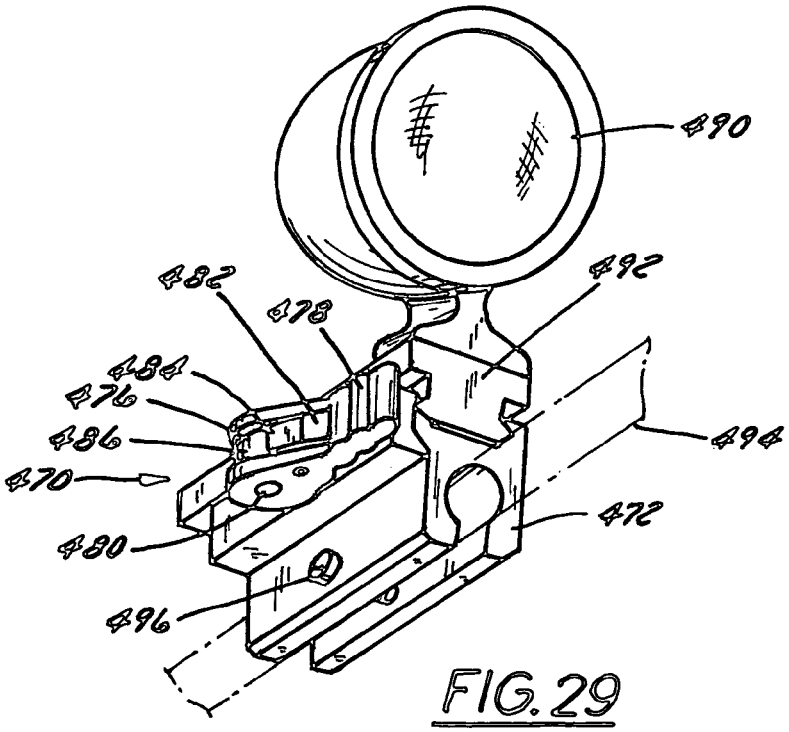
FIG. 29 is a perspective view of a light equipped with an accessory mounting system according to the present invention.

FIG. 29 shows another accessory mounting system 470 according to the present invention. Accessory mounting system 470 includes a first clamp member 472 and a second clamp member 474 that are movably associated with one another along a shaft 476 that extends therebetween. A lever 478 is secured to shaft 476 by pivot pin 480. Lever 478 is eccentrically engaged with pivot pin 480 and is rotatable thereabout. Rotation of lever 478 about pivot pin 480 opens and closes accessory mounting system 470. A lock 482 is pivotably secured to lever 478 and cooperates with a notch 484 formed in head portion 486 of shaft 476. A light assembly 490 has a base or rail portion 492 that removably cooperates with the variable width cavity formed between first clamp member 472 and second clamp member 474 as lever 478 is rotated about pivot pin 480. First clamp member 472 is constructed to be secured to a support or rail 494 affixed to an underlying vehicle. It is appreciated that rail 494 could be secured to virtually any vehicle including any of the on and off-road vehicles and non ground vehicles described above. It is further appreciated that rail 494 could form any number of a variety of structures of the underlying vehicle structures including luggage or carrier racks, vehicle frame tube members, brush guards, rollover protection rails, bed or bed cover rails, mirror support tubes, etc. An optional set screw 496 secures first clamp portion 472 relative to vehicle rail 494. It is further appreciated that accessory mounting system 470 be secured directly to the electronic accessory, such as light 490, and be shaped and configured such that first clamp member 472 and second clamp member 474 are sized and shaped to directly interact with the vehicle rail 494. Although such a configuration detracts from the versatility of the accessory mounting system 470, in eliminating the need for the generally uniform dovetail rail 492, such a system yields an accessory support system wherein the mounting and/or clamping structures are fully supported by the accessory or vehicle itself and thereby simplifies manufacturing and use of accessory mounting system 470.

Figure 30:
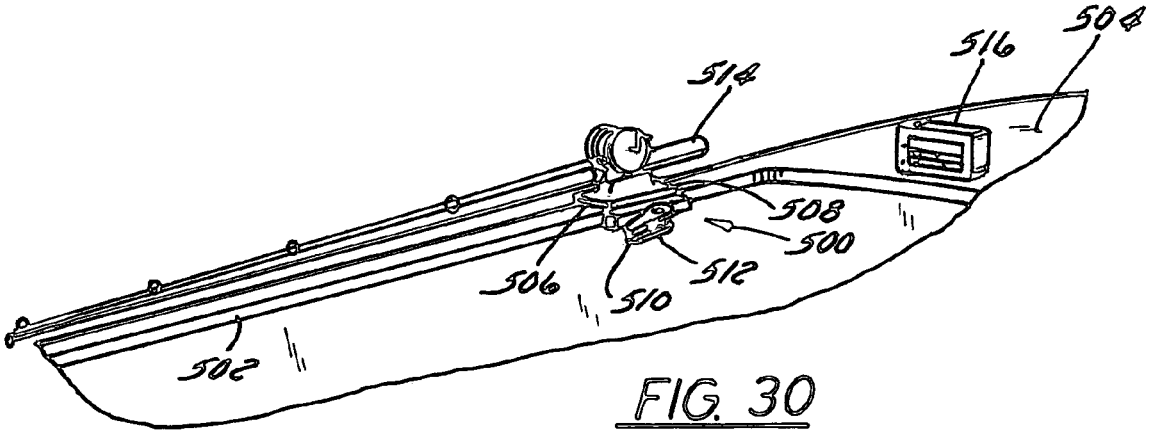
FIG. 30 is a perspective view of a fishing pole secured to a boat with an accessory mounting system according to the present invention.
Figure 31:
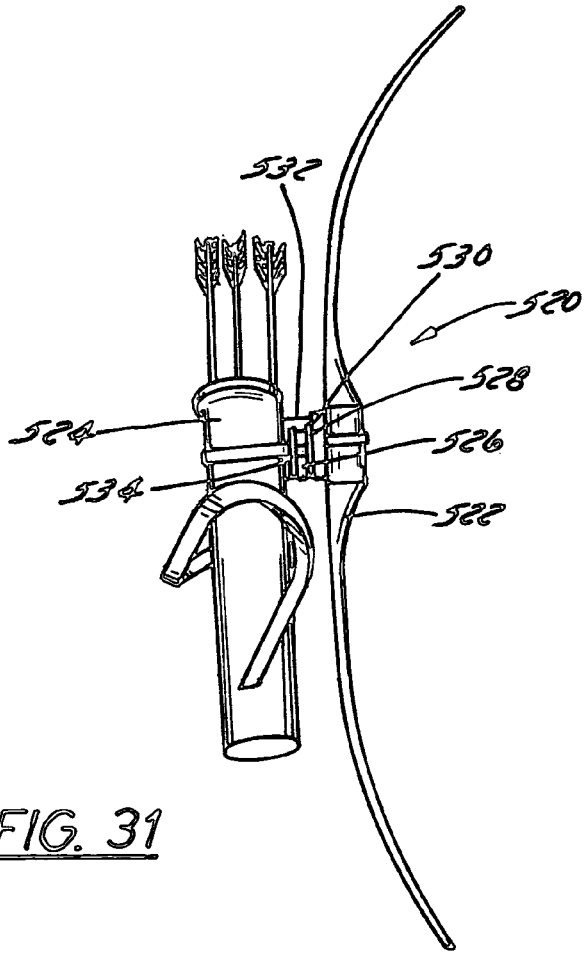
FIG. 31 is a perspective view of a bow having a quiver attached thereto with an accessory mounting system according to the present invention.
Figure 32:
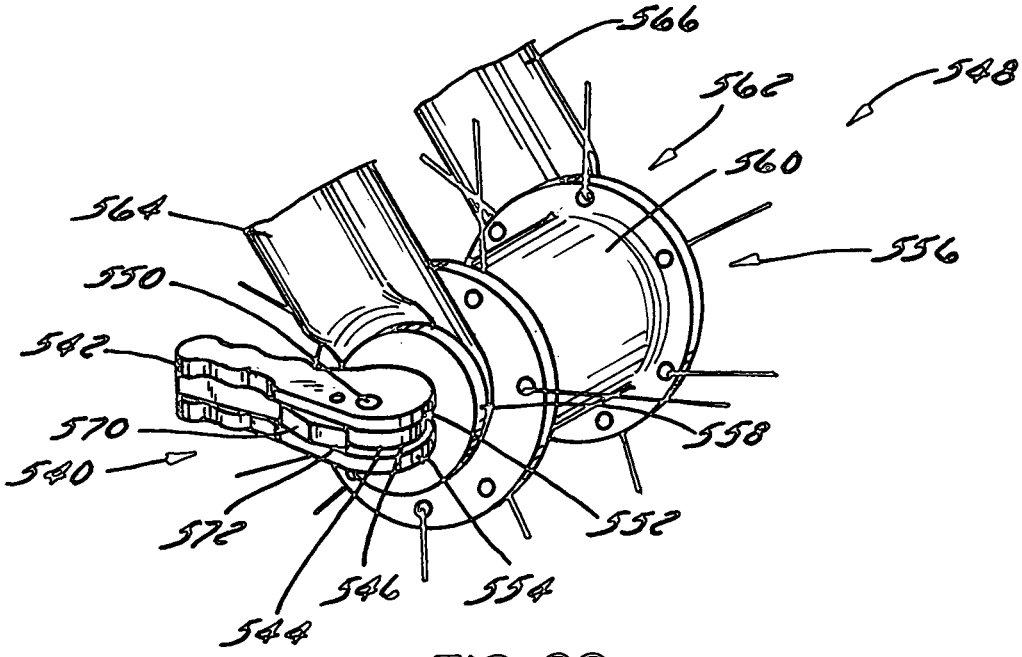
FIG. 32 is a perspective view of a bicycle wheel assembly wherein an accessory mounting system according to the present invention secures the wheel to the dropouts of the bicycle.

FIGS. 30 and 31 show other alternate uses of other accessory mounting systems 500 like accessory mounting systems 402, 404, 470 according to the present invention. Referring to FIG. 30, accessory mounting system 500 is secured or otherwise attached to a structure such as a top rail 502 of a watercraft such as a boat 504. Accessory mounting system 500 includes a first clamp portion 506 and a second portion 508 that are moveable relative to one another in response to manipulation a lever 510. A lock 512 is engage with lever 510 and prevents unintended or undesired manipulation of lever 510 relative to first or second clamp portions 506, 508. Similar to the various embodiments described above, manipulation of lever 510, only when lock 512 is not engaged with the notch on the shaft, alters a distance between first clamp member 506 and second clamp member 508 so that when closed, a fishing accessory, such as a downrigger or fishing rod 514 as shown, can be securely attached to boat 504. When desired to be used, the single handed manipulation of lever 510 and lock 512 allows the removable of fishing rod 514 from boat 504. Similar to accessory mounting system 402, it is further envisioned that electronic fishing accessories, such as a GPS, depth gauges, and/or a fishfinder 516 can also be secured or otherwise supported by vessel 504 with an accessory mounting system 500. It is further appreciated that boat 504 includes multiple mounting systems whose positions are associated with in-use and stored support of the respective accessories.

FIG. 31 shows another accessory mounting system 520 according to the present invention. As shown in FIG. 31, accessory mounting system 520 is disposed between a bow 522 and a quiver assembly 524. A lever 526 is connected to a shaft 528 that connects a first clamp portion 530 and a second clamp portion 532. Like the various accessory mount systems described above, manipulation of lever 526 allows the selective engagement and removal of quiver 524 from bow 522. Accessory mount system 520 includes a lock 534 that is pivotably attached to lever 526 and engages a notch formed in the head portion of shaft 528. When lock 534 is engaged with the notch of the shaft 528, lever 526 cannot be rotated relative to first clamp member 530 and second clamp member 532 thereby securely maintaining the engagement between quiver 524 and bow 522. It is further appreciated that accessory mounting system 520 could be positioned on bow 522 to accommodate the mounting of one or more of sights or lights for use during a bow shooting activity.

Figure 33:
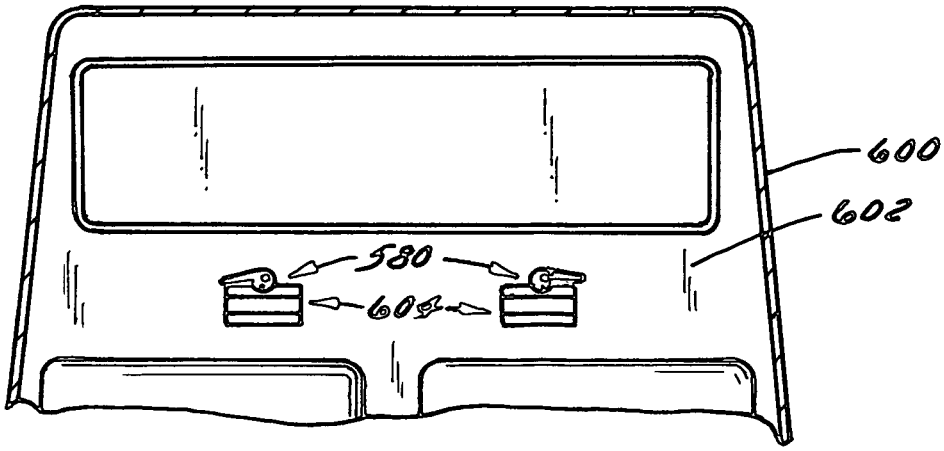
FIG. 33 is an elevational view of a rear wall of a road vehicle, such as a pickup truck, having a number of accessory mounting systems secured thereto and variably positioned to support any of a number of accessories.

FIG. 33 shows another accessory mounting system 540 according to the present invention. The accessory mounting system 540 includes a lever 542 that is pivotably attached to a head portion 544 of the shaft 546. Accessory mounting system 540 forms what is commonly referred to as an axle and quick release assembly associated with a bicycle wheel assembly 548. A pivot pin 550 passes through opposite arms 552, 554 of lever 542 and head portion 544 of shaft 546. A first clamp member 556 and a second clamp member 558 are positioned on generally opposite lateral sides of bicycle wheel assembly 548. Manipulation of lever 542 relative to second clamp member 558 alters a distance between first clamp member 556 and second clamp member 558 so as to allow a hub 560 of bicycle wheel 548 to be disengaged from a dropout assembly 562 of bicycle. When lever 542 is rotated to an open position, first clamp member 556 and second clamp member 550 are free to be disengaged from the alternate fork tips 564, 566 of the underlying bicycle.

When lever 542 is rotated to a close position, first clamp member 556 and second clamp member 558 are moved toward one another due to the eccentric mounting of lever 542 such that the first and second clamp members 556, 558 are positioned to cooperate with the fork tips 564, 566 to secure hub 560 to the bicycle. A lock 570 is pivotably attached to lever 542 and cooperates with the notch 572 formed in head portion 544 of shaft 546. When lock 570 is engaged with notch 572, lever 542 cannot rotate relative to shaft 546 thereby ensuring that hub 560 cannot inadvertently disengage from fork tips 564, 566. It is further appreciated that one or more of accessory mounting systems 402, 404, 470, 500, 520 can be configured to cooperate with other structures of the underlying bicycle for securing accessories other than the wheel, such as a water bottle, water bottle holder, or an accessory container, to the underlying bicycle. It is further appreciated that such systems thereto.

FIG. 33 shows yet another aspect of the present invention. As shown in FIG. 33, a number of accessory supporting systems 580 are secured to a vehicle 600 such as to the rear wall 602 of a pickup. The construction and operation of accessory mounting systems 580 are similar to the accessory mounting systems as described above. It is appreciated that although support systems 580 can provide in-use support of any number of accessories, being located in the back seat of a pick-up lends the interaction to a stored or stowed interaction with any of a number of accessories including the firearms as shown in various of FIGS. 1-24. Each of accessory mounting systems 580 defines a variable width opening 604 that is adapted to removably cooperate with, and secure, one or more accessories to the accessory mounting system 580. It should be appreciated that whereas a number of the various embodiments shown in FIGS. 25-32 represent in-use and stored orientations associated with the various accessories and accessory mounting systems shown therein, accessory mounting systems 580 are constructed to support an accessory in a stored, stowed, or non-use position. That is, it is envisioned that any of the various firearms and/or accessories described herein be configured to cooperate with one or more accessory mounting systems 402, 404, 470, 500, 520, 580 that are supported in either an in-use position and/or a stored location such that at least the various accessories described herein can be conveniently transported and rigidly supported when in-use and/or when stored and/or when stowed for transport or between uses.

It is further appreciated that the various accessories discussed herein are merely exemplary accessories usable with the present invention. It is envisioned that the various accessory mounting systems be usable with any accessory and/or underlying vehicle wherein it is desired to securely support the accessory at one or more locations and/or when it is desired to securely support an accessory with one or more different vehicles. It is further appreciated that, although the accessory mounting systems are generally shown as being secured to the underlying vehicle, the construction could be altered such that the accessory mounting system is fully supported and removable from the vehicle with the respective accessory. It is further envisioned that the any of the various accessory mounting systems be configured to directly cooperate with structure of either the accessory of the intended vehicle thereby negating the use of a particle rail. Regardless of the particular application, vehicle, accessory, and desired number and locations of intended support, each accessory support system 402, 404, 470, 500, 520, 580 provides an accessory support that rigidly but selectively connects an accessory and an underlying vehicle. The lockable nature of each of support systems 402, 404, 470, 500, 520, 580 prevents inadvertent loss or disengagement with the respective accessory. The adjustable nature of the length of the shaft associated with each of 402, 404, 470, 500, 520, 580 provides a severable support system that can be individualized to cooperate with a range of accessories rather than one particular accessory and/or vehicle shape or size. Accordingly, the present invention provides a lockable accessory support system that is highly versatile and robust.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Further, although many components described herein are physically separate modules, it will be manifest that they may be integrated into an associated component. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A system for mounting an accessory to a support structure comprising:

a shaft having a longitudinal axis and a head portion formed at an end of the shaft;

a lever connected to the head portion of the shaft by a pin that extends through the head portion of the shaft such that an exterior surface of the head portion of the shaft remains exposed, the lever being rotatable about an axis oriented in a crossing direction relative to the longitudinal axis of the shaft;

a notch formed in the exterior surface of the head portion of the shaft; and a lock pivotably attached to the lever and positioned to selectively interact with the notch formed in the exterior surface of the head portion of the shaft so that the lock prevents rotation of the lever relative to the shaft when the lock is engaged with the notch.

2. The system of claim 1 further comprising a first clamp member and a second clamp member wherein one of the first clamp member and the second clamp member is engaged with the shaft proximate the head portion so that rotation of the lever alters a distance between the first clamp member and the second clamp member.

3. The system of claim 2 wherein the first clamp member and the second clamp member cooperate with a rail so that when the shaft is positioned adjacent the rail and the lock is engaged with the notch, the first clamp member and the second clamp member are secured to the rail.

4. The system of claim 1 wherein the shaft includes a first part and a second part that movably engage one another to alter a length of the shaft.

5. The system of claim 4 wherein the head portion is integral with the first part of the shaft and the second part of the shaft threadingly engages the first part.

6. The system of claim 1 wherein the accessory is further defined as at least one of an electronic device, a cell phone, a global positioning systems (GPS), a range finder, a fish finder, a speaker, a light, a camera, a computer, an electronic sight, a television, a device container, a bag, a utility box, a firearm, a fishing pole, a fishing pole rack, a quiver, a wheel, a liquid container, a water bottle, and a downrigger, and the support structure is further defined as at least one of a motorized vehicle, a human powered vehicle, a road vehicle, a recreational vehicle, a camper, a car, a truck, an all-terrain vehicles (ATV), a three-wheeler, a four wheeler, an amphibious vehicles, a watercraft, a personal watercraft (PWC), a canoe, a boat, a golf cart, a motorcycle, and a bicycle.

7. The system of claim 6 wherein a rail is secured to one of the accessory and the support structure and the system for mounting an accessory is secured to the other of the accessory and the support structure.

8. A quick release accessory mount system comprising:

a mount secured to a first structure; and a release assembly secured to a second structure and selectively engageable with the mount, the release assembly comprising:

a shaft;

a first clamp member and a second clamp member captured between alternate ends of the shaft;

a lever attached to the shaft adjacent one of the first clamp member and the second clamp member and rotatable relative to the shaft to alter a distance between the first clamp member and the second clamp member; and a lock supported by the lever to be pivotable relative to the lever and positioned to interact in direct contact with the shaft to selectively prevent rotation of the lever.

9. The quick release assembly of claim 8 wherein the lever is adjacent one of the first clamp member and the second clamp member.

10. The quick release assembly of claim 9 further comprising a nut engaged with the shaft and adjacent the other of the first clamp member and the second clamp member.

11. The quick release assembly of claim 8 wherein the lever includes a pair of arms and a portion of the shaft and at least a portion of lock are positioned between the pair of arms.

12. The quick release assembly of claim 11 wherein one of the first clamp member and the second clamp member includes a seat that engages the pair of arms of the lever.

13. The quick release assembly of claim 8 further comprising a notch formed in a head portion of the shaft and arranged to receive a portion of the lock.

14. The quick release assembly of claim 13 further comprising a spring that biases the portion of the lock into engagement with notch.

15. The quick release accessory mount system of claim 8 wherein the first structure is at least one of an electronic device, a cell phone, a global positioning systems (GPS), a range finder, a fish finder, a speaker, a light, a camera, a computer, an electronic sight, a television, a device container, a bag, a utility box, a firearm, a fishing pole, a fishing pole rack, a quiver, a wheel, a liquid container, a water bottle, a downrigger, a motorized vehicle, a human powered vehicle, a road vehicle, a recreational vehicle, a camper, a car, a truck, an all-terrain vehicles (ATV), a three-wheeler, a four wheeler, an amphibious vehicles, a watercraft, a personal watercraft (PWC), a canoe, a boat, a golf cart, a motorcycle, and a bicycle and the second structure is another of an electronic device, a cell phone, a global positioning systems (GPS), a range finder, a fish finder, a speaker, a light, a camera, a computer, an electronic sight, a television, a device container, a bag, a utility box, a firearm, a fishing pole, a fishing pole rack, a quiver, a wheel, a liquid container, a water bottle, a downrigger, a motorized vehicle, a human powered vehicle, a road vehicle, a recreational vehicle, a camper, a car, a truck, an all terrain vehicles (ATV), a three-wheeler, a four wheeler, an amphibious vehicles, a watercraft, a personal watercraft (PWC), a canoe, a boat, a golf cart, a motorcycle, and a bicycle.

16. A method of forming a quick release clamp assembly comprising;

connecting a first clamp member and a second clamp member with a shaft;

engaging a lever with the shaft so that the lever can be rotated to alter a distance between the first clamp member and the second clamp member;

attaching a button to the lever so that the button is pivotable relative to the lever and movable relative to the shaft; and positioning the button on the lever so the button can prevent movement of the lever in a first direction when the button is engaged with a notch formed on the shaft.

17. The method of claim 16 further comprising biasing the button into engagement with the notch.

18. The method of claim 16 further comprising securing the lever to the shaft about an eccentric pivot.

19. The method of claim 16 further comprising positioning the button between a pair of arms of the lever that secures the lever to the shaft.

20. The method of claim 16 further comprising securing a first mount body to at least one of an electronic device, a cell phone, a global positioning systems (GPS), a range finder, a fish finder, a speaker, a light, a camera, a computer, an electronic sight, a television, a device container, a bag, a utility box, a firearm, a fishing pole, a fishing pole rack, a quiver, a wheel, a liquid container, a water bottle a downrigger, a motorized vehicle, a human powered vehicle, a road vehicle, a recreational vehicle, a camper, a car, a truck, an all-terrain vehicles (ATV), a three-wheeler, a four wheeler, an amphibious vehicles, a watercraft, a personal watercraft (PWC), a canoe, a boat, a golf cart, a motorcycle, and a bicycle and securing the quick release clamp assembly to another of at least one of an electronic device, a cell phone, a global positioning systems (GPS), a range finder, a fish finder, a speaker, a light, a camera, a computer, an electronic sight, a television, a device container, a bag, a utility box, a firearm, a fishing pole, a fishing pole rack, a quiver, a wheel, a liquid container, a water bottle, a downrigger, a motorized vehicle, a human powered vehicle, a road vehicle, a recreational vehicle, a camper, a car, a truck, an all-terrain vehicles (ATV), a three-wheeler, a four wheeler, an amphibious vehicles, a watercraft, a personal watercraft (PWC), a canoe, a boat, a golf cart, a motorcycle, and a bicycle.

21. The method of claim 16 further comprising moving the first clamp member closer to the second clamp member when the lever rotates in a direction wherein the button is engaged with the notch than when the lever rotates in an opposite direction.

22. A system for mounting an accessory to a support structure comprising:

a shaft having a longitudinal axis and a head portion, the shaft including a first part and a second part wherein the head portion of the shaft is integral with a first part and the second part of the shaft threadingly engages the first part so that the first part and the second part movably engage one another to after a length of the shaft;

a lever connected to the head portion of the shaft and rotatable about an axis oriented in a crossing direction relative to the longitudinal axis of the shaft;

a notch formed in the head portion of the shaft; and a lock pivotably attached to the lever and positioned to selectively interact with the notch so that the lock prevents rotation of the lever relative to the shaft when the lock is engaged with the notch.

* * * * *